US010683135B2

(12) United States Patent
Gabrys

(10) Patent No.: US 10,683,135 B2
(45) Date of Patent: Jun. 16, 2020

(54) CORRUGATED SKID WITH OPTIMUM SUPPORT

(71) Applicant: Christopher W. Gabrys, Reno, NV (US)

(72) Inventor: Christopher W. Gabrys, Reno, NV (US)

( * ) Notice: Subject to any disclaimer, the term of this patent is extended or adjusted under 35 U.S.C. 154(b) by 143 days.

(21) Appl. No.: 15/741,255

(22) PCT Filed: Dec. 29, 2017

(86) PCT No.: PCT/US2017/069117

§ 371 (c)(1),
(2) Date: Dec. 30, 2017

(87) PCT Pub. No.: WO2018/164760

PCT Pub. Date: Sep. 13, 2018

(65) Prior Publication Data

US 2019/0185207 A1 Jun. 20, 2019

Related U.S. Application Data

(63) Continuation-in-part of application No. PCT/US2016/000057, filed on Jul. 11, 2016, and a (Continued)

(51) Int. Cl.
*B65D 19/00* (2006.01)

(52) U.S. Cl.
CPC ..... *B65D 19/0075* (2013.01); *B65D 19/0028* (2013.01); *B65D 2519/00019* (2013.01);

(Continued)

(58) Field of Classification Search
CPC ..... B65D 19/20; B65D 2519/00019; B65D 2519/00054

(Continued)

(56) References Cited

U.S. PATENT DOCUMENTS 2,856,826 A 10/1858 Norquist
2,696,356 A * 12/1954 Baumann ..... B65D 19/0016 108/51.3

(Continued)

FOREIGN PATENT DOCUMENTS

DE 43 07 515 A1 9/1994
WO WO-2014003823 A1 * 1/2014 ..... B65D 19/0012

OTHER PUBLICATIONS

English Translation of Wilbert (DE4307515) (Year: 2019).*

*Primary Examiner* — Matthew W Ing
(74) *Attorney, Agent, or Firm* — J. Michael Neary

(57) ABSTRACT

A corrugated skid includes top and bottom blanks that are folded and assembled together to produce a double thickness deck supported by double thickness ribs that are folded downward from deck portions of each blank. The ribs of the top blank are split into three sections by two fork passages. The three sections penetrate through slots in the deck portion formed by the bottom blank. The double thickness ribs of the top and bottom blanks intersect with notches at a location below the deck. The double thickness ribs of the top and bottom blanks intersect each other near the center of the corrugated skid to form a continuous four-sided rib support rectangle that resists shifting between the top and bottom blanks.

17 Claims, 18 Drawing Sheets

Related U.S. Application Data continuation-in-part of application No. 14/999,860, filed on Jul. 11, 2016, now Pat. No. 9,796,503.

(60) Provisional application No. 62/193,727, filed on Jul. 17, 2015, provisional application No. 62/205,087, filed on Aug. 14, 2015, provisional application No. 62/306,612, filed on Mar. 10, 2016, provisional application No. 62/444,497, filed on Jan. 10, 2017.

(52) U.S. Cl.
CPC ..... *B65D 2519/00054* (2013.01); *B65D 2519/00273* (2013.01); *B65D 2519/00288* (2013.01); *B65D 2519/00293* (2013.01); *B65D 2519/00323* (2013.01); *B65D 2519/00338* (2013.01); *B65D 2519/00562* (2013.01); *B65D 2519/00567* (2013.01)

(58) Field of Classification Search
USPC ..... 108/51.3
See application file for complete search history.

(56) References Cited

U.S. PATENT DOCUMENTS

| | | | | |
|---|---|---|---|---|
| 2,908,464 | A | 10/1959 | Traudt | |
| 2,951,669 | A | 9/1960 | Davidson | |
| 3,308,772 | A | 3/1967 | Thomas, Jr. | |
| 3,464,370 | A | 9/1969 | Martin | |
| 3,520,258 | A | 7/1970 | Shephard | |
| 3,911,834 | A | 10/1975 | Quaintance | |
| 4,185,565 | A | 1/1980 | Nymoen | |
| 4,875,419 | A | 10/1989 | Helton | |
| 4,936,229 | A | 6/1990 | Parnell | |
| 4,979,446 | A | 12/1990 | Winebarger | |
| 5,176,090 | A * | 1/1993 | Roberts | B65D 19/0026 108/51.3 |
| 5,207,631 | A | 5/1993 | Schmidtke | |
| 5,218,913 | A | 6/1993 | Winebarger | |
| 5,337,679 | A * | 8/1994 | Moorman | B65D 19/0026 108/51.3 |
| 5,337,680 | A | 8/1994 | Johnson | |
| 5,350,066 | A | 9/1994 | Mendoza | |
| 5,377,600 | A | 1/1995 | Speese et al. | |
| 5,383,409 | A | 1/1995 | Hayakawa | |
| 5,427,019 | A | 6/1995 | Moorman | |
| 5,452,667 | A | 9/1995 | Lim | |
| 5,469,795 | A | 11/1995 | Moorman | |
| 5,487,345 | A * | 1/1996 | Winebarger | B65D 19/0024 108/51.3 |
| 5,528,995 | A | 6/1996 | Lim | |
| 5,701,827 | A | 12/1997 | Urabe | |
| 5,784,971 | A * | 7/1998 | Chang | B65D 19/0059 108/51.3 |
| 6,116,568 | A | 9/2000 | Rosenblat | |
| 70,000,549 | | 2/2006 | Nelson | |
| 7,007,613 | B2 | 3/2006 | Sketo | |
| 7,426,890 | B2 | 9/2008 | Olvey | |
| 8,113,129 | B1 * | 2/2012 | Hurley | B65D 19/0028 108/51.3 |
| 8,291,836 | B2 | 10/2012 | Jian | |
| 8,479,666 | B2 * | 7/2013 | Olvey | B65D 19/0012 108/51.3 |
| 9,796,503 | B2 * | 10/2017 | Gabrys | B65D 19/0012 |
| 2004/0108434 | A1 * | 6/2004 | Olvey | B65D 19/0036 248/346.02 |
| 2007/0227410 | A1 * | 10/2007 | Chen | B65D 19/0095 108/51.3 |
| 2007/0283856 | A1 | 12/2007 | Berghmans | |
| 2008/0295747 | A1 * | 12/2008 | Vinderola | B65D 19/0028 108/51.3 |
| 2012/0204767 | A1 * | 8/2012 | Jian | B65D 19/0028 108/51.3 |

* cited by examiner

CORRUGATED SKID WITH OPTIMUM SUPPORT

This is related to U.S. Provisional Application No. 62/444,497 filed on Jan. 10, 2017 entitled "Corrugated Skid with Optimum Support", and to U.S. Provisional Applications 62/193,727 filed on Jul. 17, 2015, 62/205,087 filed on Aug. 14, 2015, 62/306,612 filed on Feb. 3, 2016, and PCT Application No. PCT/US2016/000057 filed on Jul. 11, 2016, and U.S. patent application Ser. No. 14/999,860, filed on Jul. 11, 2016, which issued as U.S. Pat. No. 9,796,503 on Oct. 24, 2017.

This invention pertains to pallets and skids for shipping goods, and more particularly to a corrugated skid comprising two pieces of corrugated sheet that fold together having integral folded support ribs for toughness. The skid uniquely provides increased deck support for shipping smaller sized goods, but most importantly provides increased resistance for maintaining support ribs in desired vertical orientation during lifting, sliding and fork impacts. The skid thereby maintains load carrying capability and stability of shipped goods while also allowing rapid on-site assembly from only two sheets of corrugated material.

BACKGROUND OF THE INVENTION

Pallets are said to move the world. Eighty percent of commerce ships on pallets. The pallet industry is estimated at greater than $30 B worldwide. More than 500 million pallets are manufactured in the US each year, with 1.8 billion pallets in service in the US alone.

Pallets can be made from various materials, however wood pallets currently comprise about 80% of the market. More than 40% of worldwide hardwood lumber currently goes toward the manufacturing of wood pallets. Other materials used for pallet manufacturing include plastic, metal and corrugated paperboard.

Recent regulations regarding infestation and contamination are creating a surge in interest and use of non-wood pallet alternatives. A small, but fast growing segment is the use of corrugated paperboard pallets. Many desire to replace conventional wooden pallets with corrugated pallets for reducing costs, increasing ability to recycle, lowering pallet weight, eliminating product contamination, reducing pallet storage volume and reducing pallet related injuries.

Many different designs of corrugated paperboard pallets have been developed to date. Despite the potential advantages of corrugated pallets, many have suffered from several different deficiencies. These deficiencies include low strength and stiffness, high use of corrugated paperboard, resulting in higher material costs, warehouse space, assembly labor and freight costs. The inherent inability to readily produce and distribute corrugated pallets in sufficiently high volume has also been a critical factor in the commercial failures of almost all prior art corrugated paperboard pallets.

Corrugated skids, i.e. corrugated pallets without a bottom deck, are quite desirable because they can be made very lightweight and also because they do not waste material for a bottom deck that is easily damaged without contributing to supporting a load above the floor. They also lack sidewalls that are also easily damaged in box type corrugated pallets. Corrugated skids are also able to be moved with stacker type forklifts used in many parts of the world because of a lack of bottom deck. Corrugated skids can be constructed of a top deck with glued on supports or by two pieces with support from integral folded ribs. Corrugated skids with glued on supports have a tendency for the supports to become loose, in addition to requiring much more material and assembly costs. Corrugated skids with integral folded ribs are more desirable. Unfortunately, these types of skids can sometimes encounter deviation of the support ribs from vertical, mostly from blank shifting during abusive handling. Deviation from the vertical orientation of the support ribs can reduce the load carrying capability as well as stability of the shipped load of goods.

Accordingly, a new corrugated skid is needed that has folded ribs integral with the deck, and also providing an increased structural integrity to maintain the support ribs in vertical orientation for supporting the load. Such a skid would be more durable for lifting, sliding and fork impacts. The light weight of such a novel skid would greatly reduce the shipping costs of goods, particularly in the case of air shipments, at an overall cost significantly less than the use of conventional pallets and skids, even those made of corrugated material. Ideally, such a novel skid could be shipped to a user in the form of stacks of flat blanks that could be rapidly assembled as needed at the point of use without the need for large volumes of storage space to accommodate assembled pallets or skids.

SUMMARY OF THE INVENTION

The invention provides a corrugated skid with integral folded support ribs that are folded down from a double thickness supporting deck. The support ribs are uniquely locked to each other to maintain improved resistance to deviation from vertical orientation, allowing maximum load capability and stability. The construction is typically also completed from only two pieces of corrugated board, thereby substantially reducing material costs and assembly labor and time. The corrugated skid can be shipped as two flat blanks and assembled on-site prior to use in only about 30 seconds.

The corrugated skid of the invention is comprised of two blanks that are folded and assembled together. Each blank comprises double thickness ribs that are folded downward from a supporting deck portion. The ribs of the top blank are split into three sections by two fork passages. The three top blank rib sections penetrate through slots in the deck portion formed by the bottom blank, and the double thickness ribs of the top and bottom blanks intersect with notches at a location below the deck portion. Near the center of the corrugated skid, the double thickness ribs of the top and bottom blanks intersect each other to form a continuous four-sided rib support rectangle that resists shifting between the top and bottom blanks.

In an additional embodiment, relative motion between the top and bottom blanks is resisted in eight locations of the four-sided rib support rectangle which comprises the corners of the rectangle at the deck portion slots and at the intersecting notches at a lower elevation.

Maintaining vertical orientation of the support ribs is important during lifting as well as when resting on the floor. The width and shape of the bottoms of the support ribs can also aid in resisting deviation of rib orientation from vertical. In an additional embodiment, the crest fold lines of each rib comprises cut open sections that rest squarely on the floor separated by shorter length hinge sections. The cut open sections would tend to undesirably allow moisture into the mediums of the corrugated from the ground, especially when set on a moist surface tarmac. However, we have found that they also provide a square and much wider support than if not cut open, and that more importantly make the ribs much more stable.

The corrugated skids can be constructed with four way entry allowing lifting with fork equipment from all four sides, or alternative two way entry. Two way entry provides a stronger and more durable skid due to greater top deck support and greater rib avoidance of fork impacts. We have found that the support in a two way skid in accordance with the invention can be maximized through the spacing of the top blank ribs and their intersection with the bottom blank ribs. In a further embodiment of the invention, a two way skid is ideally constructed such that the ribs of the bottom blank run continuously between opposite ends of the skid and are intersected by four ribs of the top blank each separated by spaces, middle space, N, and two outer spaces, O, wherein $0.7 \leq (N/O) \leq 1.3$. With this construction, in addition to providing more uniform top deck for smaller sized boxes and loads, the spacing of the top blank ribs distributes the resistance to rolling or deviation of the bottom blank ribs due to handling.

Although the corrugated skids in accordance with the invention can be made of varying size, we have found that the variation of support rib locations surprisingly have a usual specific desired range. Typical pallets in much of the world have a height allowance for pallet jack entry of around 3.5 inches, a common board width used in wooden pallets. We have found that when bottom blank rib spacing for corrugated skids in accordance with the invention becomes too close to the edge of the skid, there is a greater tendency for the bottom blank ribs to not resist changes in vertical orientation. It turns out that the difference between width of bottom blank ribs and top blank width of the skid is preferably not less than twice the height allowance or underneath height of the skid deck. Additionally, if the bottom blank ribs are set too far inward, the rib resistance is desirably increased, however the skid loses significant stability on the floor as well as makes entry ways less visible for operator use. We have found that this stability is of particular importance when skids of goods are double or triple stacked. Accordingly, in an additional embodiment of the invention, the corrugated skid has a top blank width in inches, A, and a bottom blank outer rib spacing in inches, E, wherein $7.0 \leq (A-E) \leq 12.0$.

Not only are the variation of support rib locations able to increase the skid resistance to vertical deviation and stability, but we have found that the ratio of top blank fork openings can also improve top deck support. More uniform top deck support is achieved by the double thickness ribs of the top and bottom blanks intersecting each other to form a continuous four-sided rib support rectangle that resists shifting between the top and bottom blanks. However, support can be further maximized by the ratio of fork passage widths. In a further embodiment of the invention, the corrugated skid has a top blank outer fork passage width, B, and a top blank inner fork passage width, C, wherein $0.35 \leq (C/B) \leq 0.45$. This ratio minimizes the unsupported span, allowing heavy but smaller sized boxes or loads to be reliably shipping using the corrugated skid in accordance with the invention.

Maximizing deck support can also be achieved for different sized pallets and handling equipment through varying the inner and outer fork passage widths of the top blank in accordance with the pallet top blank width. Accordingly, we have found in an additional embodiment of the invention that maximum support can typically be achieved if the corrugated skid preferably has a top blank width in inches, A, a top blank outer fork passage width in inches, B, and a top blank inner fork passage width in inches, C, wherein if $A \geq 39$, then $B \leq 30$ and $C \geq 10$, and if $A < 39$, then $B \leq 24.25$ and $C \geq 6$.

The four sided rib support rectangle resists blank shifting because two parallel ribs are each intersected by two perpendicular ribs, and the vertical height of the perpendicular ribs is much greater than the vertical thickness of the deck alone, thereby greatly increasing orientation support. In a further embodiment of the invention, the corrugated skid is comprised of two blanks that are folded and assembled together wherein each blank comprises double thickness ribs that are folded downward from a deck portion. The ribs of the top blank are split into sections that penetrate slots in the deck portion formed by the bottom blank, and the ribs of the top blank and the bottom blank intersect each other with notches at a location below the deck portion. Near the middle of the corrugated skid, two uninterrupted ribs of the top blank intersect with two uninterrupted ribs of the bottom blank, whereby the intersections resist motion through both the slots at the deck portion and through the notches below the deck portion. Without the intersections of the uninterrupted ribs, the skid would rely only on the support against the much thinner deck between all adjacent parallel ribs. Support rib orientation resistance is thereby greatly increased.

As mentioned previously, the corrugated skids can be made with four way entry or with stronger, two way entry. However, for some shipping applications such as fully filling out trailers or containers with particular size pallets, four way entry is required. In such applications, we have found that pallet stability can be maximized in many cases by the selection of the direction of the top blank ribs. In an additional embodiment of the invention, the top blank ribs are run in the wider direction of the corrugated skid. The top blank ribs must necessarily penetrate slots in the bottom blank deck portion, so the overall length of the top blank ribs must be less than the top blank width. Choosing the wider direction of the corrugated skid to correspond with the direction of the top blank ribs has been found to provide the highest floor stability as well and top support particularly with skids having equivalent fork passage widths on all sides.

The resistance against rib deflection so as to maintain desired rib vertical orientation is achieved through the center intersections of uninterrupted ribs at the notch locations and deck slot locations. However, stability and load capacity can also be increased through the floor contact of the support ribs, through maximizing the contact area. In a further embodiment, the corrugated skid is comprised of two blanks that are folded and assembled together wherein each blank comprises double thickness ribs that are folded downward from a deck portion and the ribs of the top blank are split into three sections by two fork passages. The three sections penetrate through slots in the deck portion formed by the bottom blank and the double thickness ribs of the top and bottom blanks intersect with notches at a location below the deck portion. In the center of the corrugated skid, four continuously intersecting ribs and the crest fold lines of the ribs form cut open sections that rest squarely on the floor separated by shorter length hinge sections. The cut open sections provide both a square edge, as compared to a point typically if not cut open, and they also greatly increase the contact area. The stability and rib orientation resistance to deviation, for reliable shipping, is further increased.

DESCRIPTION OF THE DRAWINGS

The invention and its many advantages and features will become better understood upon reading the following detailed description of the preferred embodiments in conjunction with the following drawings, wherein.

DESCRIPTION OF THE PREFERRED EMBODIMENT

Figure 1A:
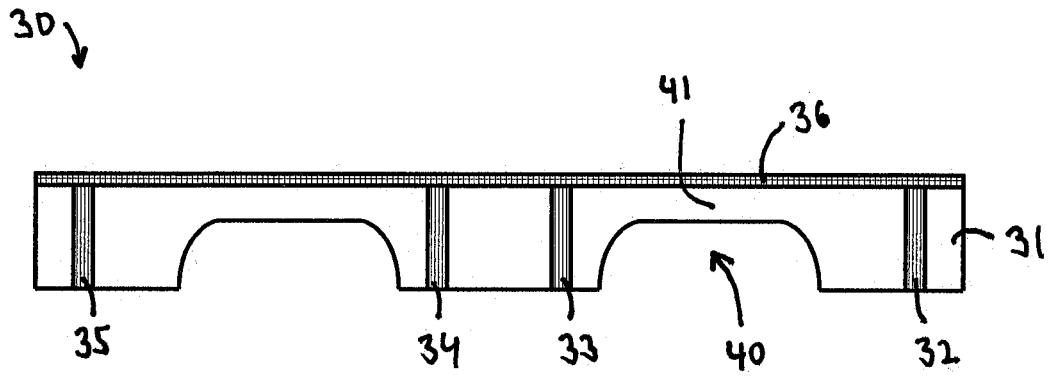
Fig. 1A (Prior Art)
FIGS. 1A and 1B are side and bottom view drawings of a beam and deck type corrugated skid of prior art.
Figure 1B:
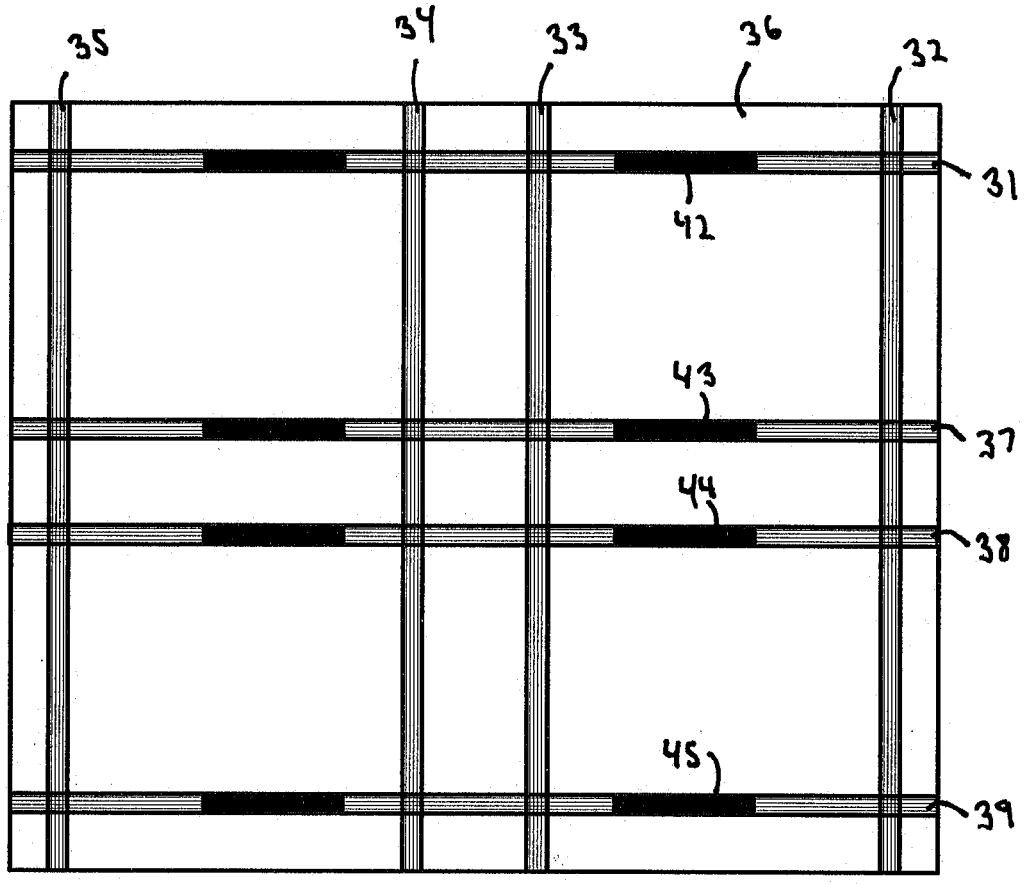
Fig. 1B (Prior Art)

Turning to the drawings, wherein like reference characters designate identical or corresponding parts, FIGS. 1A and 1B are side and bottom view drawings of a beam and deck type corrugated skid of prior art. Although this type of corrugated paperboard skid has been in the market place for quite some time, it is far from desirable because of the required high amount of board use and inherent costs. The skid 30 is constructed of notched laminated corrugated beams 32, 33, 34, and 35 that are assembled together with intersecting beams 31, 37, 38 and 39 and a deck sheet 36 adhered on top. Beams 31, 32, 33, 34, 35, 37, 38, 39 have fork passages 40 to allow lifting by pallet jacks or fork lifts and a continuous beam portion 41 above the passages. Because the beams 41 must be continuous above the fork passages 40, the skid 30 is required to be taller than desirable, using additional board. When lifting the skid 30, lifting forks act on the bottom sides of the beams in concentrated areas 42, 43, 44, 45 instead of dispersed across the underside of the top deck 36. The concentrated lifting areas 42, 43, 44, 45 requires that the beams 31, 37, 38, 39 be made thicker than desirable to carry the load, using additional board. As a result of the design inefficiencies, the beam and deck type corrugated skid has a weight of around 17 pounds and is inherently costly even without considering the beam laminating labor.

Figure 2A:
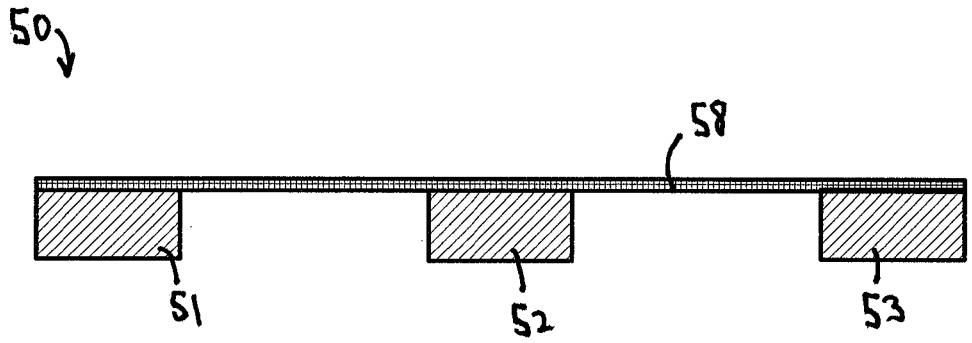
Fig. 2A (Prior Art)
FIGS. 2A and 2B are side and bottom view drawings of a block and deck type corrugated skid of prior art.
Figure 2B:
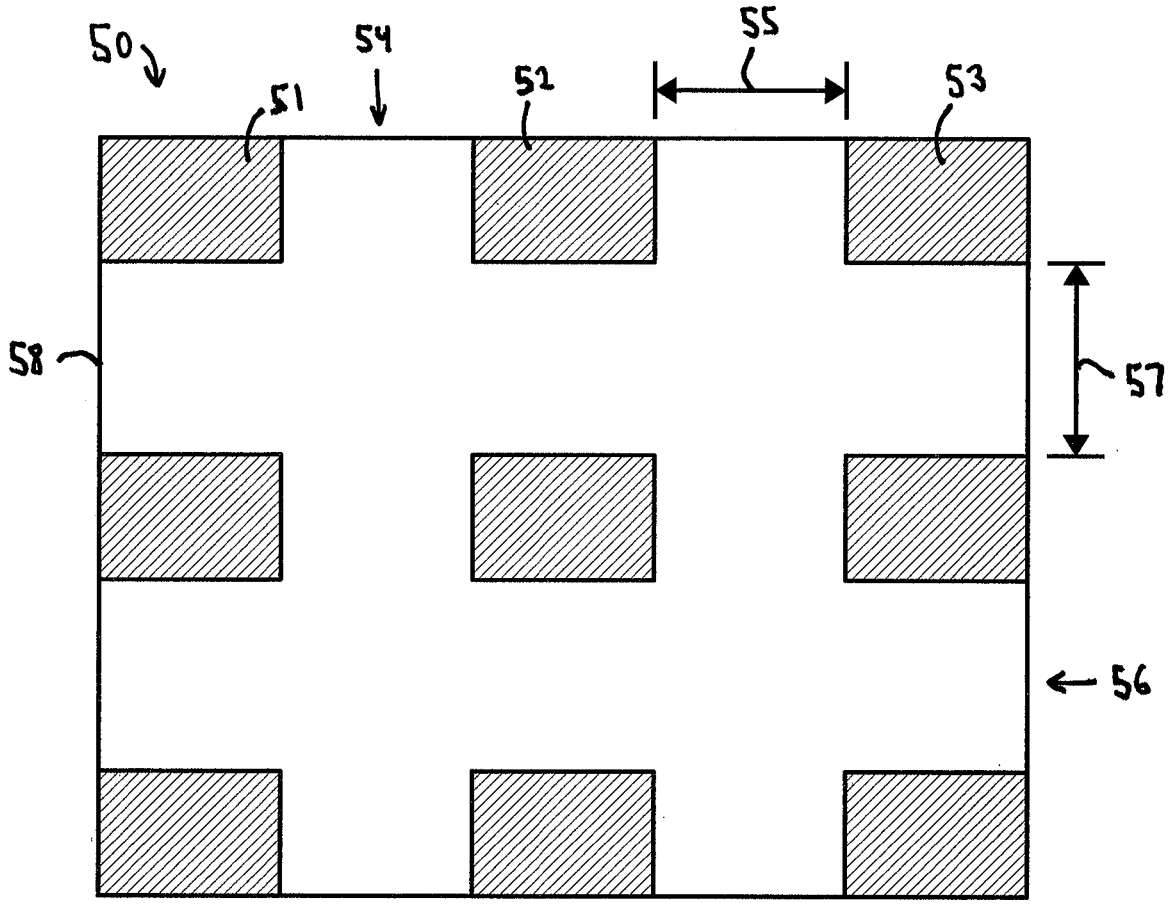
Fig. 2B (Prior Art)

FIGS. 2A and 2B are side and bottom view drawings of a block and deck type corrugated skid of prior art. Although this type of skid is used in the market place, it has drawbacks as well from high board use and less than reliable and durable construction. The skid 50 is constructed of multiple blocks 51, 52, 53 that are bonded to the bottom side of deck 58. The blocks 51, 52, 53 may be constructed of laminated corrugated board or more preferably a folded hollow box. Fork entries 54 and 56 are provided by spaces 55 and 57 between the blocks 51, 52, 53 and allow lifting of the skid 50 by fork lifts or pallet jacks. The block and deck type skids are more efficient than the beam and deck type skids with a lower weight of about 12 pounds. The main deficiency is that the blocks can be broken off and are only attached by adhesive.

Figure 3A:
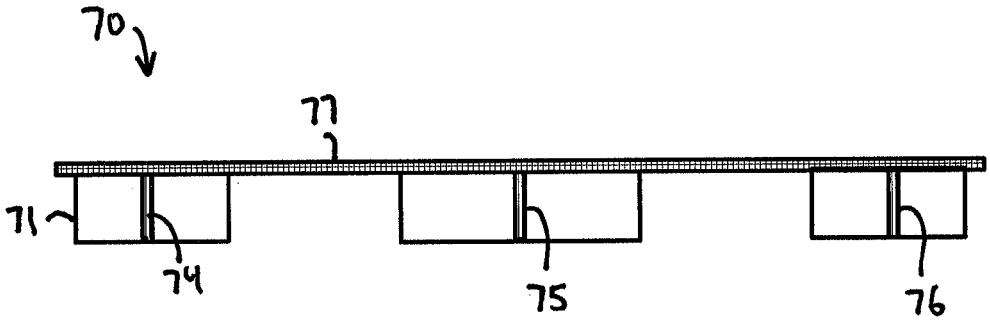
FIGS. 3A and 3B are side and bottom view drawings of a folded interlocked deck corrugated skid.
Figure 3B:
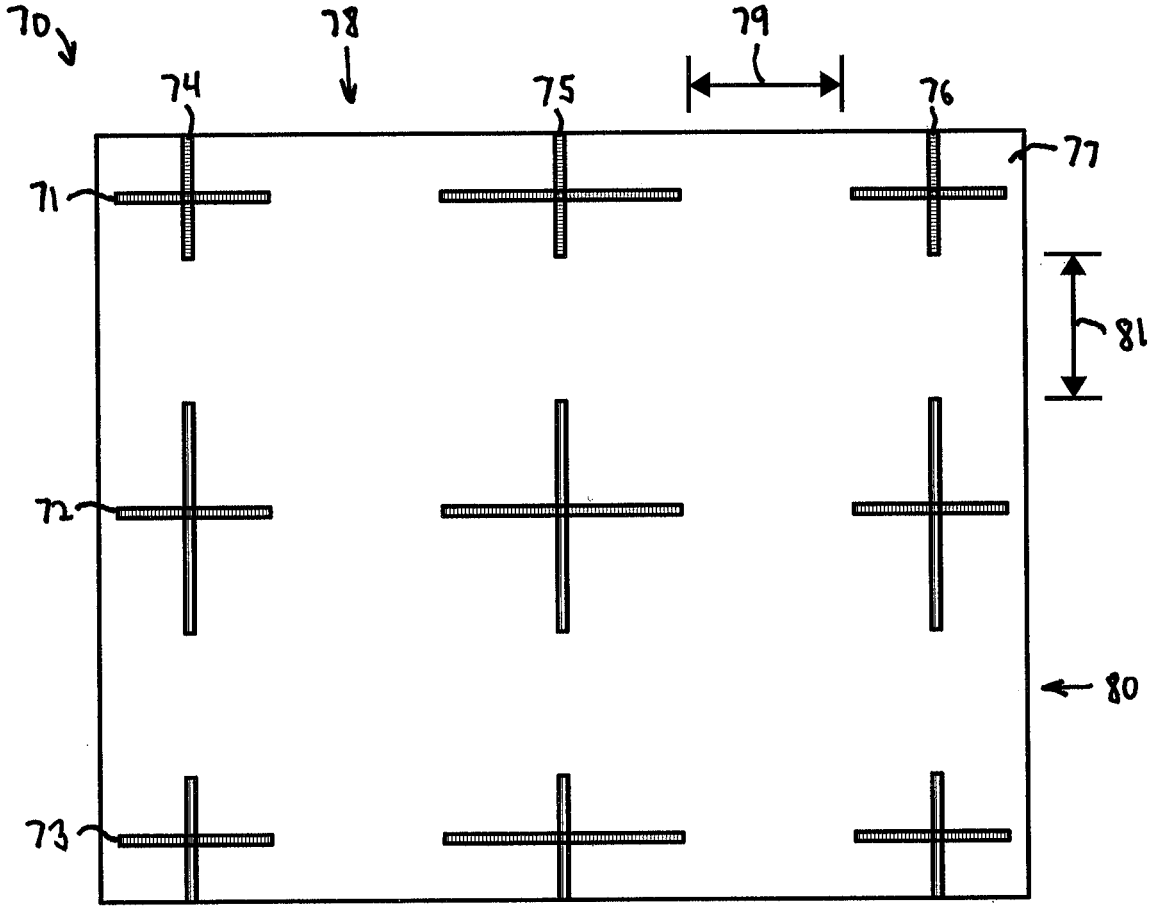

FIGS. 3A and 3B are side and bottom view drawings of a folded interlocked deck corrugated skid. In this type of skid, the supports are folded integrally from the deck and are not easily broken off. The skid 70 has a deck 77 and folded vertically extending support ribs 71, 72, 73 that intersect perpendicularly with folded vertically extending support ribs 74, 75, 76. Fork passages 78 and 80 are provided by spaces 79 and 81 between ribs 71, 72, 73, 74, 75, 76.

Figure 3C:
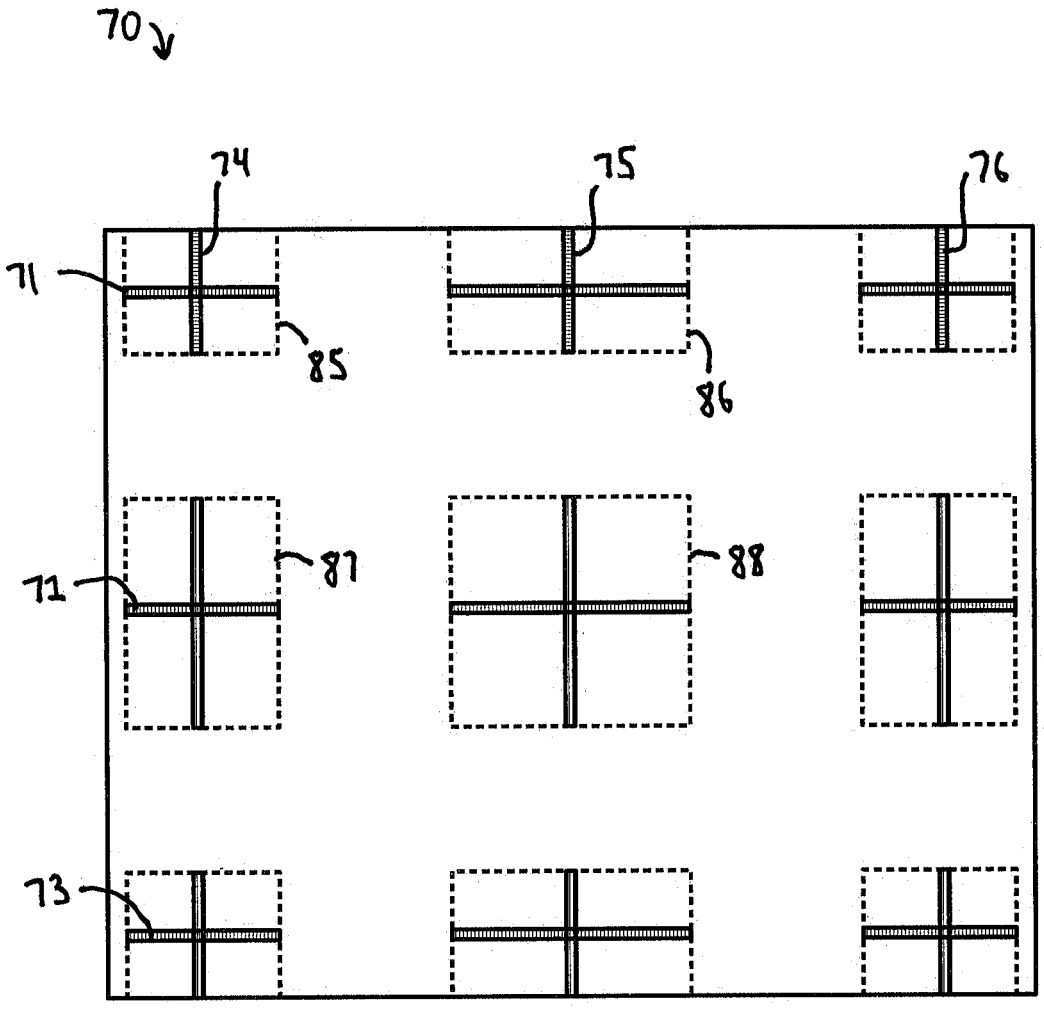
FIG. 3C is the bottom view drawing of the folded interlocked deck corrugated skid of FIGS. 3A and 3B showing the projected area of support ribs.

FIG. 3C is the bottom view drawing of the folded interlocked deck corrugated skid of FIGS. 3A and 3B showing the projected area of support ribs. Because the support ribs 71, 72, 73, 74, 75, 76 are integrally folded from the top deck 77, the supports can be easily be made as large as desired for high support capacity with large projected areas 85, 86, 87, 88

Figure 4:
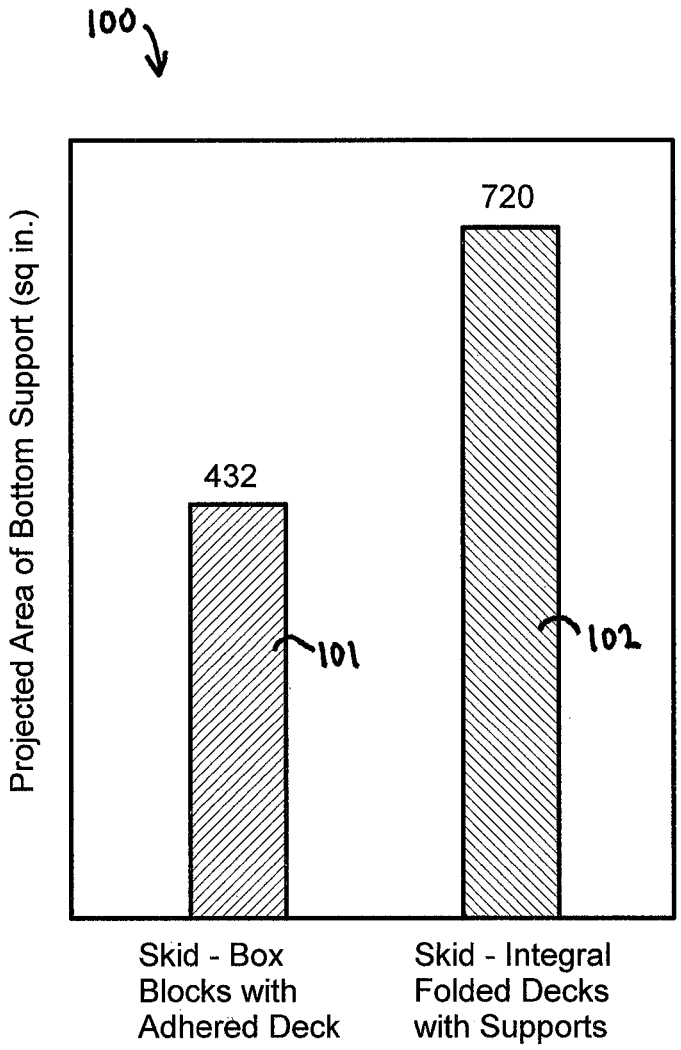
FIG. 4 is a comparison of support projected area between a block and deck corrugated skid and folded interlocked deck corrugated skid.

FIG. 4 is a comparison of support projected area between a block and deck corrugated skid and folded interlocked deck corrugated skid. The comparison 100 shows a projected support area of 432 square inches for the skid block with adhered deck skid 101 and a projected support area of 720 square inches for the integral folded deck skid 102.

Figure 5A:
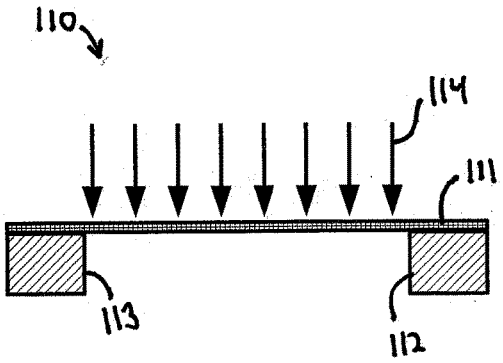
FIGS. 5A and 5B are loading and deflection diagrams for a block and deck type corrugated skid.
Figure 5B:
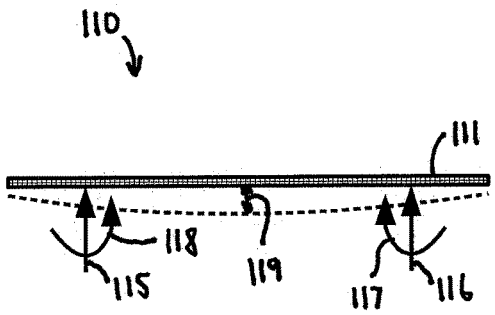

FIGS. 5A and 5B are loading and deflection diagrams for a block and deck type corrugated skid. Despite having a greater projected support area, the folded interlocked deck skids have lower top deck support than the block and deck type skids and can be insufficient for many types of loads such as smaller sized boxes. One of the reasons has to do with the geometry of the supports. The loading and deflection diagrams 110 show the deck 11 supported by wide blocks 112, 113 and loaded with a uniform deck loading 114. The supports 112 and 113 provide both vertical forces 115, 116 and moments 117, 118 that work to resist deck deflection 119.

Figure 6A:
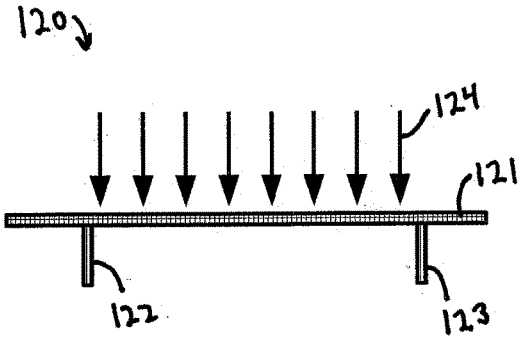
FIGS. 6A and 6B are loading and deflection diagrams for a folded interlock deck type corrugated skid.
Figure 6B:
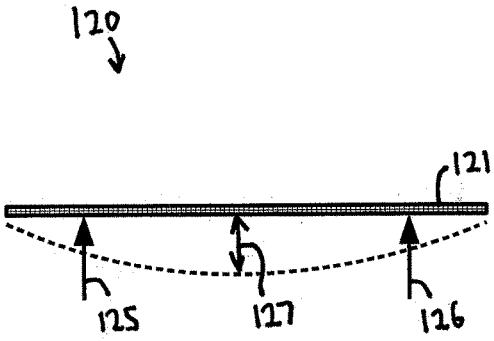

FIGS. 6A and 6B are loading and deflection diagrams for a folded interlock deck type corrugated skid. Although this type of skid may have a greater projected support area than a block and deck skid, it has higher deck deflection than desirable. One of the reasons has to do with the supports being only simply supported as line supports. The loading and deflection diagrams 120 show the deck 121 supported by narrow folded ribs 122, 123 and loaded with uniform deck loading 124. The supports 122, 123 provide only vertical forces 125, 126. As a result the top deck deflection 127 is higher.

Figure 7A:
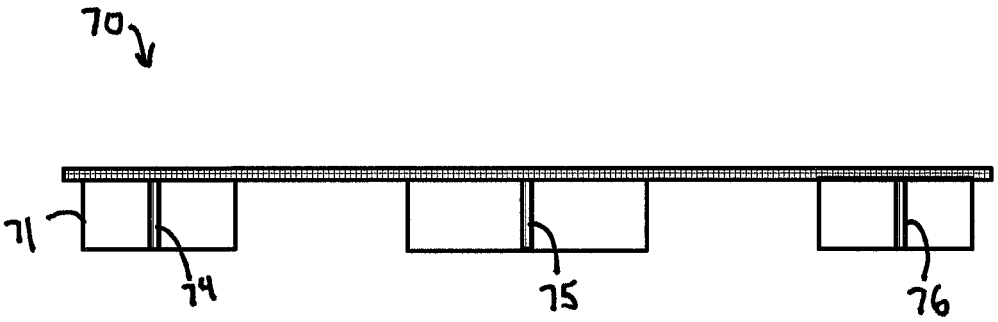
FIGS. 7A and 7B are side and bottom view drawings of a folded interlocked deck corrugated skid showing the unsupported deck area.
Figure 7B:
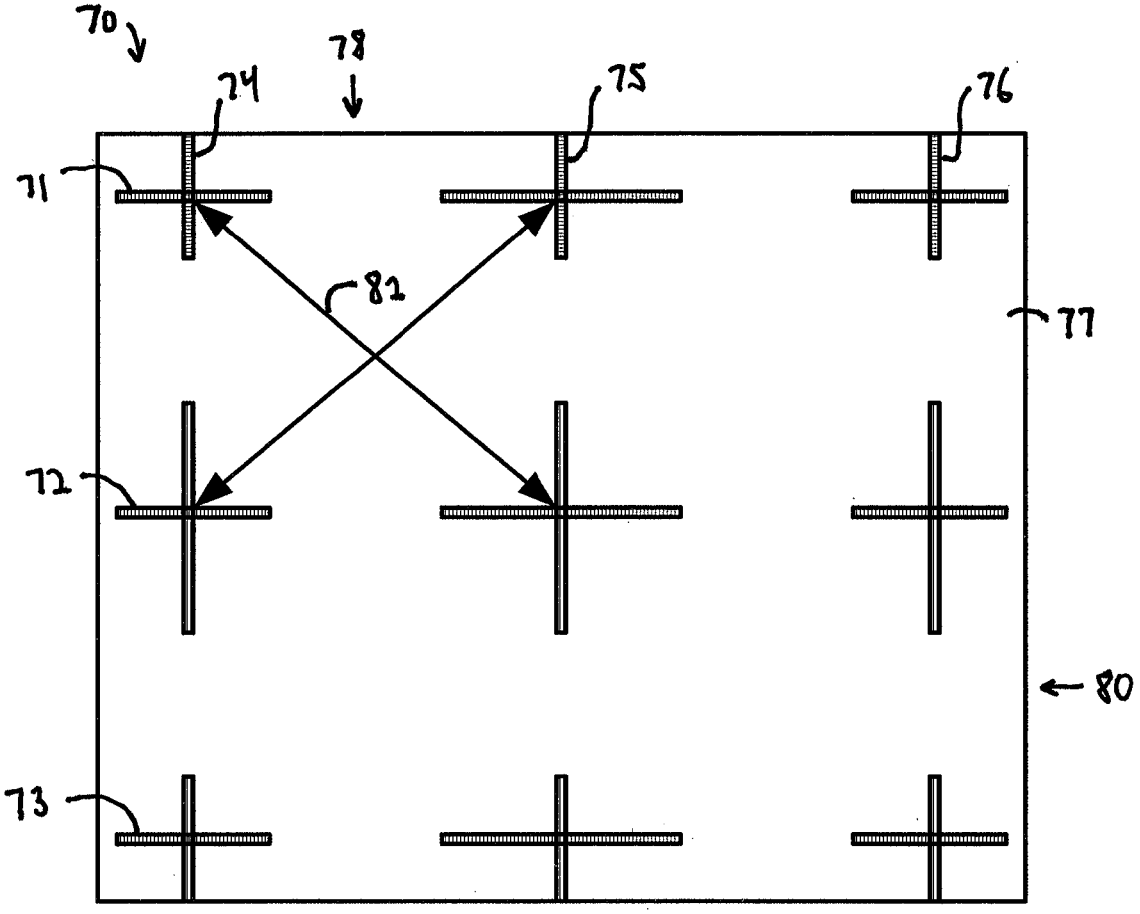

FIGS. 7A and 7B are side and bottom view drawings of a folded interlocked deck corrugated skid showing the unsupported deck area. The skid 70 is comprised of deck 77 and integral folded interlocked supports 71, 72, 73, 74, 75, 76. A closer look into the deck deflection under load shows that the projected support area is not the critical parameter; the critical parameter is the distances 82 between perpendicular intersecting supports 71, 74 and 72, 75.

Figure 7C:
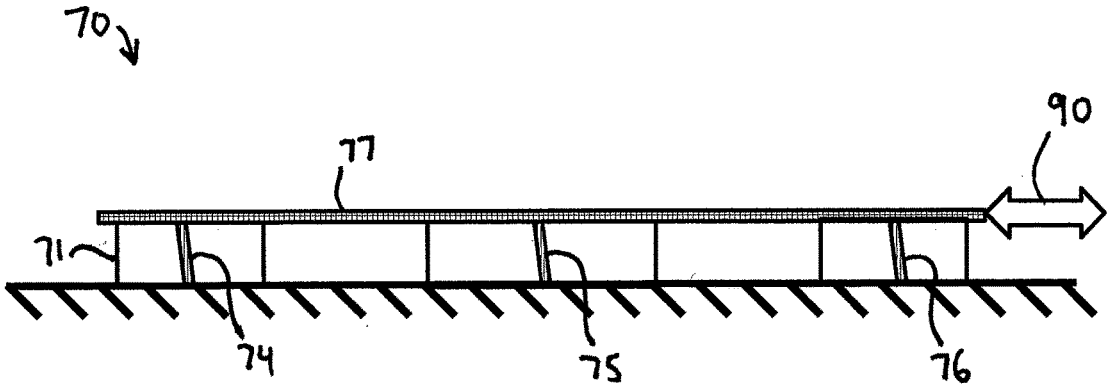
FIGS. 7C, 7D and 7E are the three rib skid of FIGS. 7A and 7B shown with failure modes from cyclic lateral vibration, lifting with unitized load and lifting with poorly unitized load, respectively.
Figure 7D:
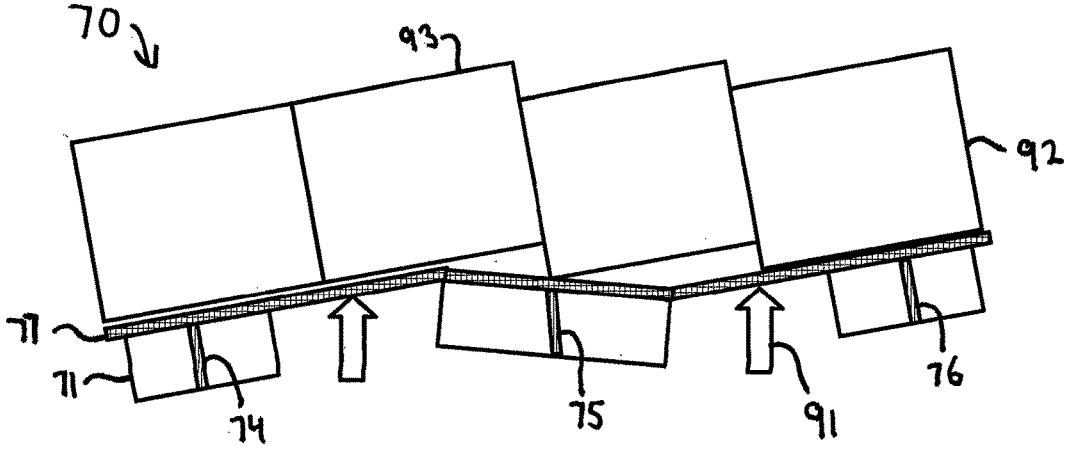
Figure 7E:
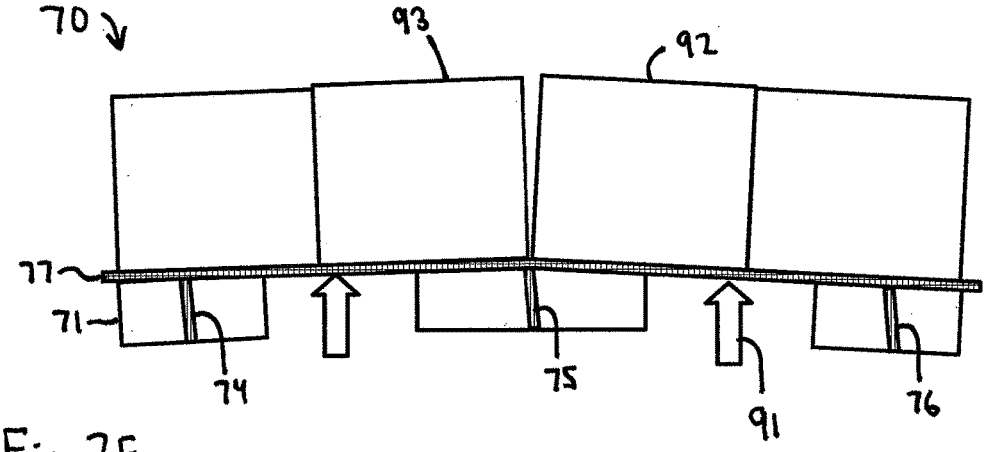

FIGS. 7C, 7D and 7E are the three rib skid of FIGS. 7A and 7B shown with failure modes from cyclic lateral vibration, lifting with unitized load and lifting with poorly unitized load, respectively. The skid 70 is comprised of the deck 77, top blank ribs 71 and intersecting three bottom blank ribs 74, 75, 76. As shown in FIG. 7C, when subjected to cyclic vibration 90, such as transport by truck, the three bottom blank ribs 74, 75, 76 have potential to shift orientation from vertical because each are only connected by the thin deck 77. The result is a loss of load capacity as well as support stability. As shown in FIG. 7D, when lifting with a unitized load, the three bottom ribs 74, 75, 76 have a potential to shift while deflecting the deck 77 in a double bend. The load boxes 92, 93 on opposite side of the corrugated skid 70 shift vertically relative to each other. As shown in FIG. 7E, when lifting with a poorly unitized load, the three bottom ribs 74, 75, 76 have a potential to shift while deflecting the top deck 77 in a single bend. The load boxes 92, 93 on opposite side of the corrugated skid 70 separate relative to each other.

Figure 8A:
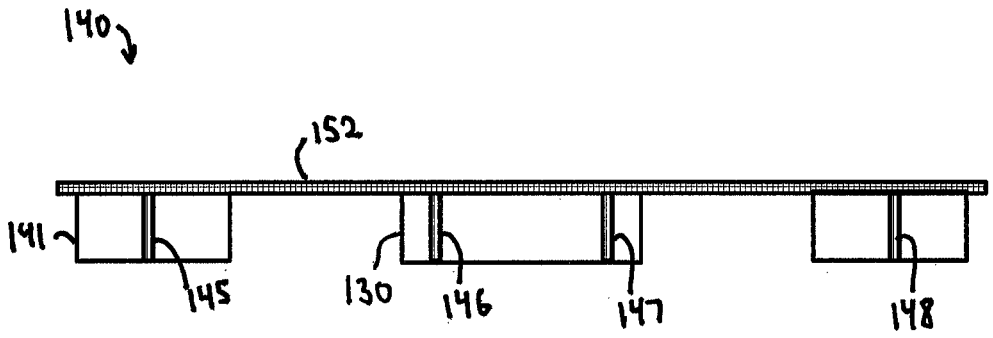
FIGS. 8A and 8B are side and bottom view drawings of a four rib folded interlocked deck corrugated skid showing the unsupported deck area in accordance with the invention.
Figure 8B:
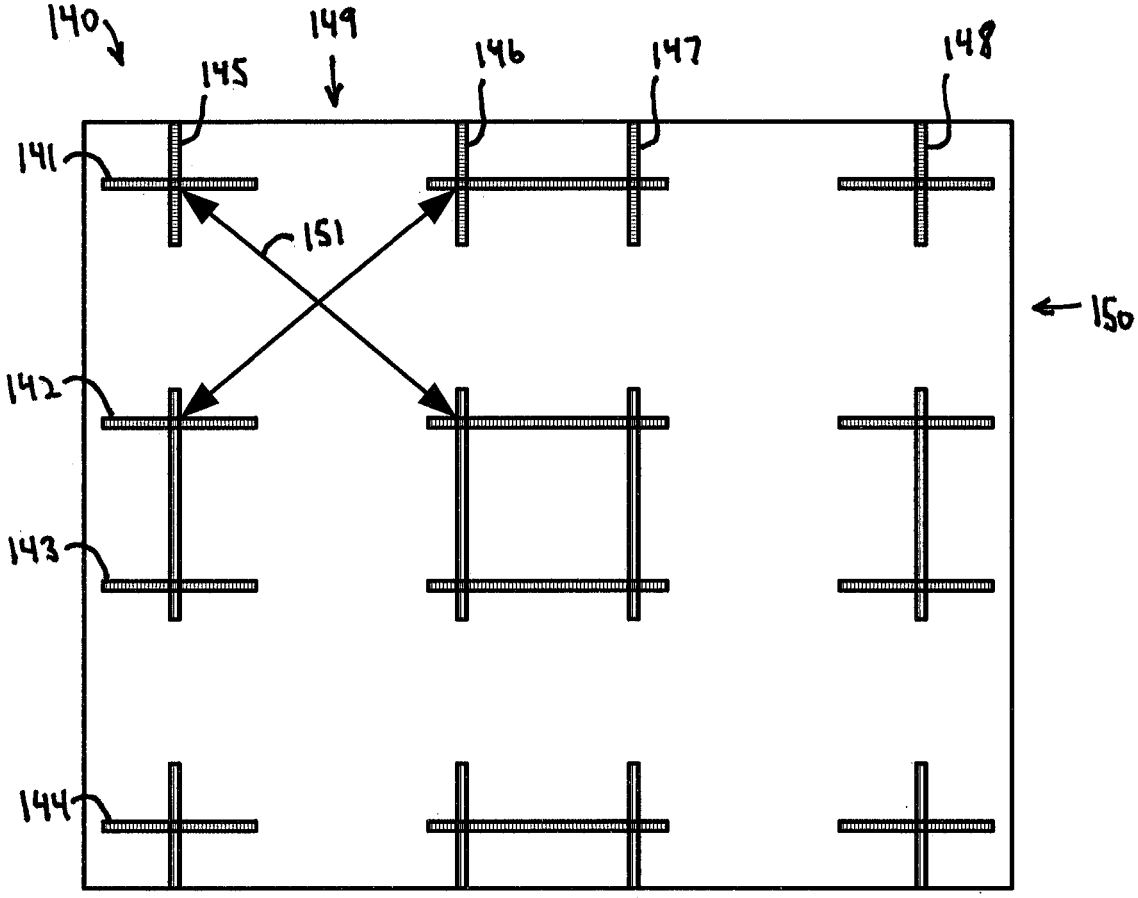

FIGS. 8A and 8B are side and bottom view drawings of a four rib folded interlocked deck corrugated skid showing the unsupported deck area in accordance with the invention. The skid 140 provides higher deck support with minimized board use through the addition of second center ribs in both directions for four ribs total folded from each deck blank. The skid 140 is comprised of a double thickness deck 152 and folded interlocked ribs 141, 142, 143, 144, 145, 146, 147, 148. Although the fork passages 149 and 150 are the same size as fork passages 78, 80, the deck support is increased through the addition of fourth folded interlocked ribs located centrally of the skid 140. The distances 151 between the perpendicular intersecting supports 141, 145 and 142, 146 are significantly shorter than the distances 82 in the skid 70 of FIGS. 7A and 7B.

Figure 8C:
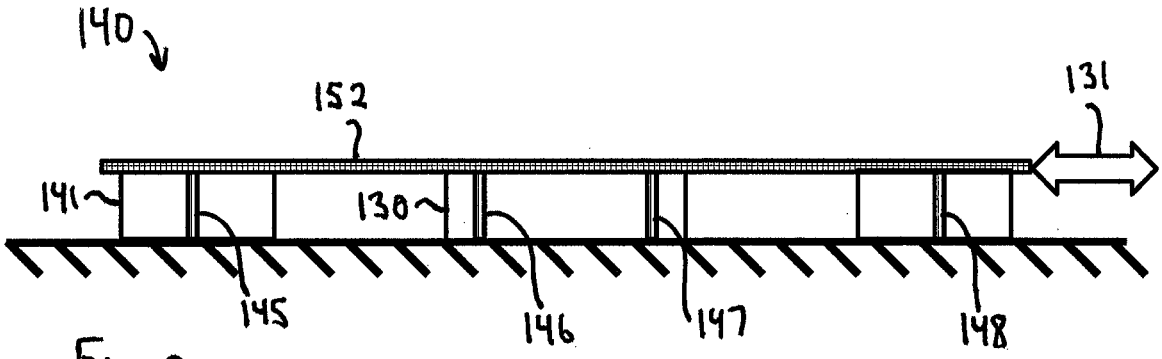
FIGS. 8C, 8D and 8E are the four rib skid of FIGS. 8A and 8B in accordance with the invention shown with failure modes from cyclic lateral vibration, lifting with unitized load and lifting with poorly unitized load, respectively.
Figure 8D:
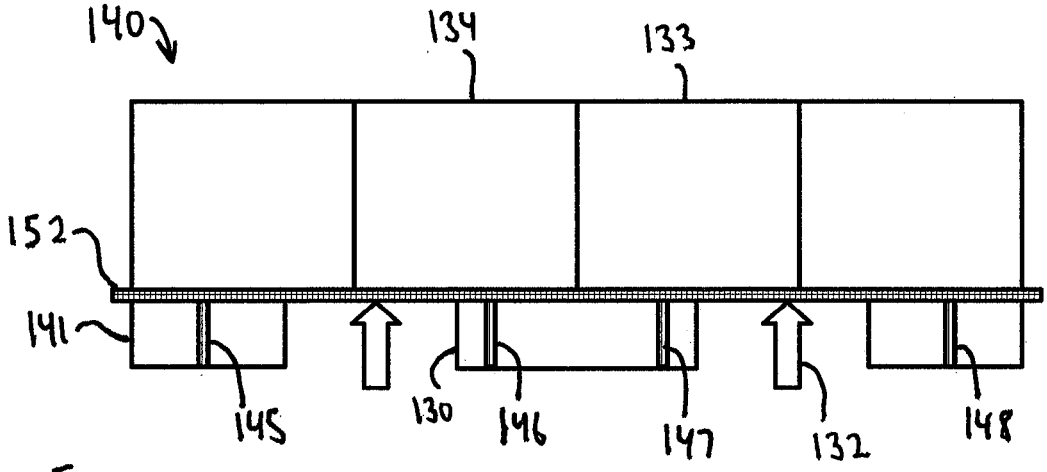
Figure 8E:
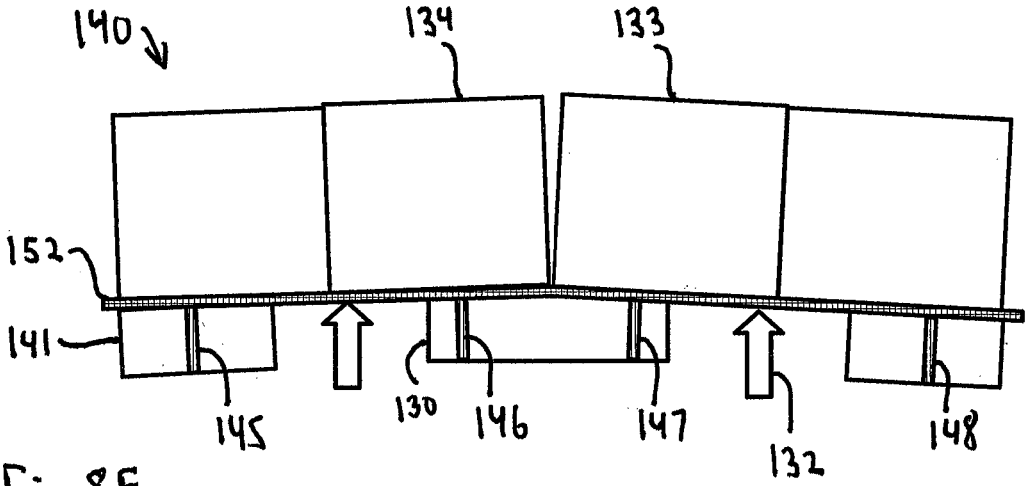

FIGS. 8C, 8D and 8E are the four rib skid of FIGS. 8A and 8B in accordance with the invention shown with failure modes from cyclic lateral vibration, lifting with unitized load and lifting with poorly unitized load, respectively. The skid 140 has the deck 152, top blank ribs 141, 142, 143, 144, and intersecting four bottom blank ribs 145, 146, 147, 148. As shown in FIG. 8C, when subjected to cyclic vibration 131, such as transport by truck, the four bottom blank ribs 145, 146, 147, 148 resist shifting orientation from vertical because the center two ribs 146, 147 are locked against blank shifting by intersecting with top blank ribs 142, 143 to form a continuous four-sided rib support rectangle that resists shifting between top and bottom blanks. The result is maintenance of the load capacity as well as support stability. As shown in FIG. 8D, when lifting with a unitized load, the four bottom ribs 145, 146, 147, 148 resist shifting orientation from vertical because the center two ribs 146, 147 are locked against blank shifting by intersecting with top blank ribs 142, 143 to form a continuous four-sided rib support rectangle that resists shifting between top and bottom blanks. The load boxes 133, 134 on opposite sides of the corrugated skid 140 stay uniformly held without shifting or substantial deflection of the top deck 152. As shown in FIG. 8E, when lifting with a poorly unitized load, the four bottom ribs 145, 146, 147, 148 resist substantial shifting orientation from vertical because the center two ribs 146, 147 are locked against blank shifting by intersecting with top blank ribs 142, 143 to form a continuous four-sided rib support rectangle that resists shifting between top and bottom blanks. The load boxes 133, 134 on opposite sides of the corrugated skid 140 may separate relative to each other due to the poor unitization, but bending of the top deck 152 is reduced, foregoing adverse effect.

Figure 9:
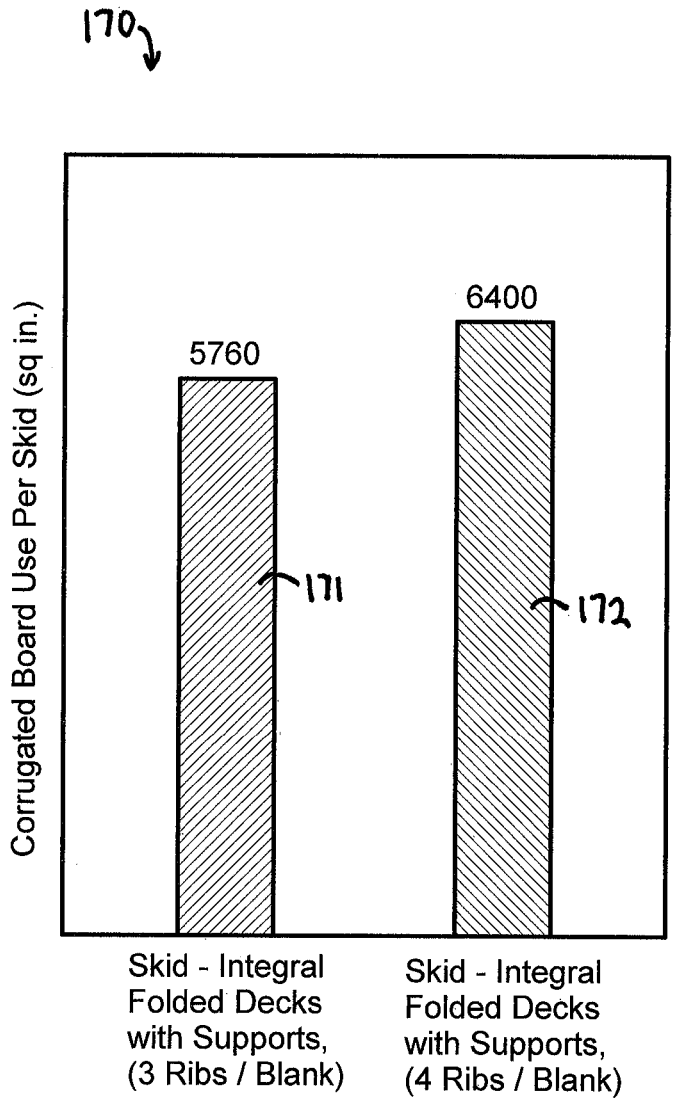
FIG. 9 is a comparison of corrugated board use between a 3 rib folded interlocked deck skid and a four rib folded interlocked deck skid in accordance with the invention.

FIG. 9 is a comparison of corrugated board use between a 3 rib folded interlocked deck skid and a four rib folded interlocked deck skid in accordance with the invention. The comparison 170 shows the integral folded deck skid with three ribs per blank uses 5760 square inches of board and the integral folded deck skid with four ribs per blank, in accordance with the invention uses 6400 square inches of board. The additional support ribs undesirably increases the board use by 11%, increasing the skid weight from 6.7 pounds to about 7.4 pounds, but still much lower than the other types of corrugated skids.

Figure 10:
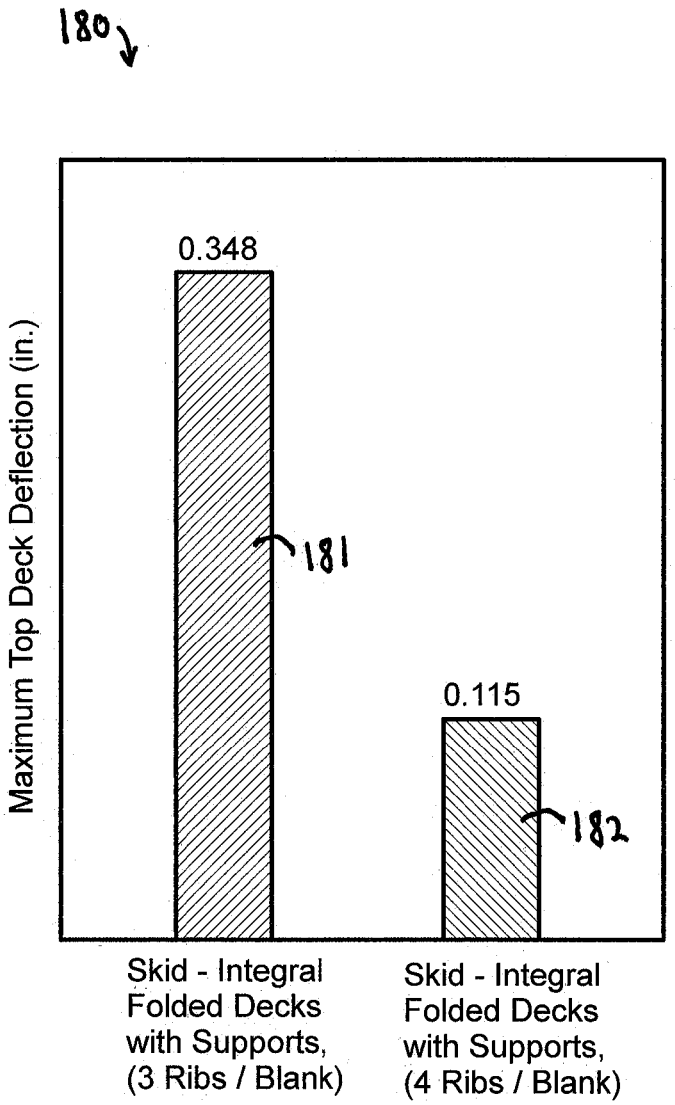
FIG. 10 is a comparison of deck deflection between a 3 rib folded interlocked deck skid and a four rib folded interlocked deck skid in accordance with the invention.

FIG. 10 is a comparison of deck deflection between a 3 rib folded interlocked deck skid and a four rib folded interlocked deck skid in accordance with the invention. A uniform deck loading of 1 psi is applied and each skid uses an effective deck elastic modulus of 100 ksi with double layer of BC doublewall. The three rib integral folded deck skid 181 has a deck deflection of 0.348 inches and the four rib integral folded deck skid, in accordance with the invention 182, has a deck deflection of 0.115 inches. The invention surprisingly provides a dramatic 67% reduction in deck deflection while requiring only an 11% increase in corrugated board use.

Figure 11:
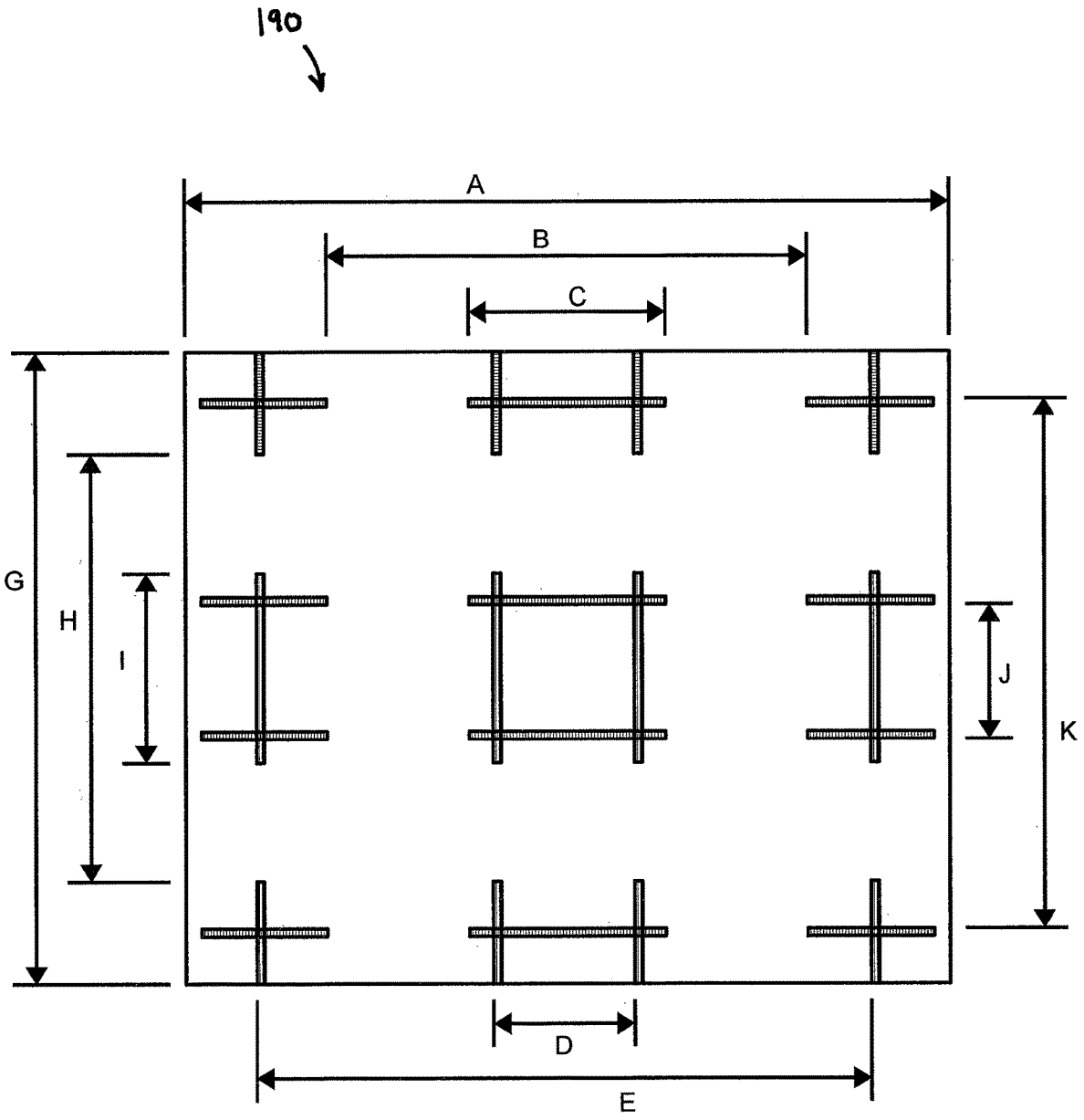
FIG. 11 is a bottom view drawing of a four rib folded interlocked deck corrugated skid in accordance with the invention with rib dimensions and locations marked.

FIG. 11 is a bottom view drawing of a four rib folded interlocked deck corrugated skid in accordance with the invention with rib dimensions and locations marked in inches. Surprisingly, certain equations for these different dimensions yield corrugated skids with greatly improved deck stiffness and handling durability. In a preferred embodiment, $2.0'' \leq (C-D) \leq 5.0''$. Within this range, the center section ribs have ample locking strength for intersecting notches while balancing with a maximum reduction in deck deflection. Likewise in an additional embodiment, $2.0'' \leq (I-J) \leq 5.0''$. This provides the same benefits in the narrow side entry direction. In additional embodiments for optimum load support, I have found that the intersection of the outer ribs should fall within a range in relation to the skid outer dimensions. Too close an intersection to the periphery and there is insufficient blank locking, while too far can make fork entry identification difficult as well as outer load boxes unstable. In these embodiments, $7.0 \leq (A-E) \leq 12.0$ for the wide side entry and $7.0 \leq (G-K) \leq 12.0$. Although the range of skid sizes varies depending on the shipping applications, in additional embodiments, $0.35 \leq (C/B) \leq 0.45$ and $0.35 \leq (I/H) \leq 0.45$. Maximum ease of use of the skids through fork entry can be further balanced with top deck support through additional embodiments based on the skid length and width dimensions. For A≥38", then B and C are preferably chosen such that B≤29" and C≥11". For A<38", then B and C are preferably chosen such that B≤23.25" and C≥7". In the narrow side entries, for G≥38", then H and I are preferably chosen such that H≤29" and I≥11". For G<38", then H and I are preferably chosen such that H≤23.25" and I≥7". I have further found that maximum support rib support of the top deck can best achieved by the orientation of the top and bottom blanks. Because the top blank ribs must penetrate the bottom blanks, they must be shorter on overall length than the bottom blank in that direction. Therefore in an additional embodiment, the top blank ribs run in the direction of the wide direction of the skid.

Figure 12:
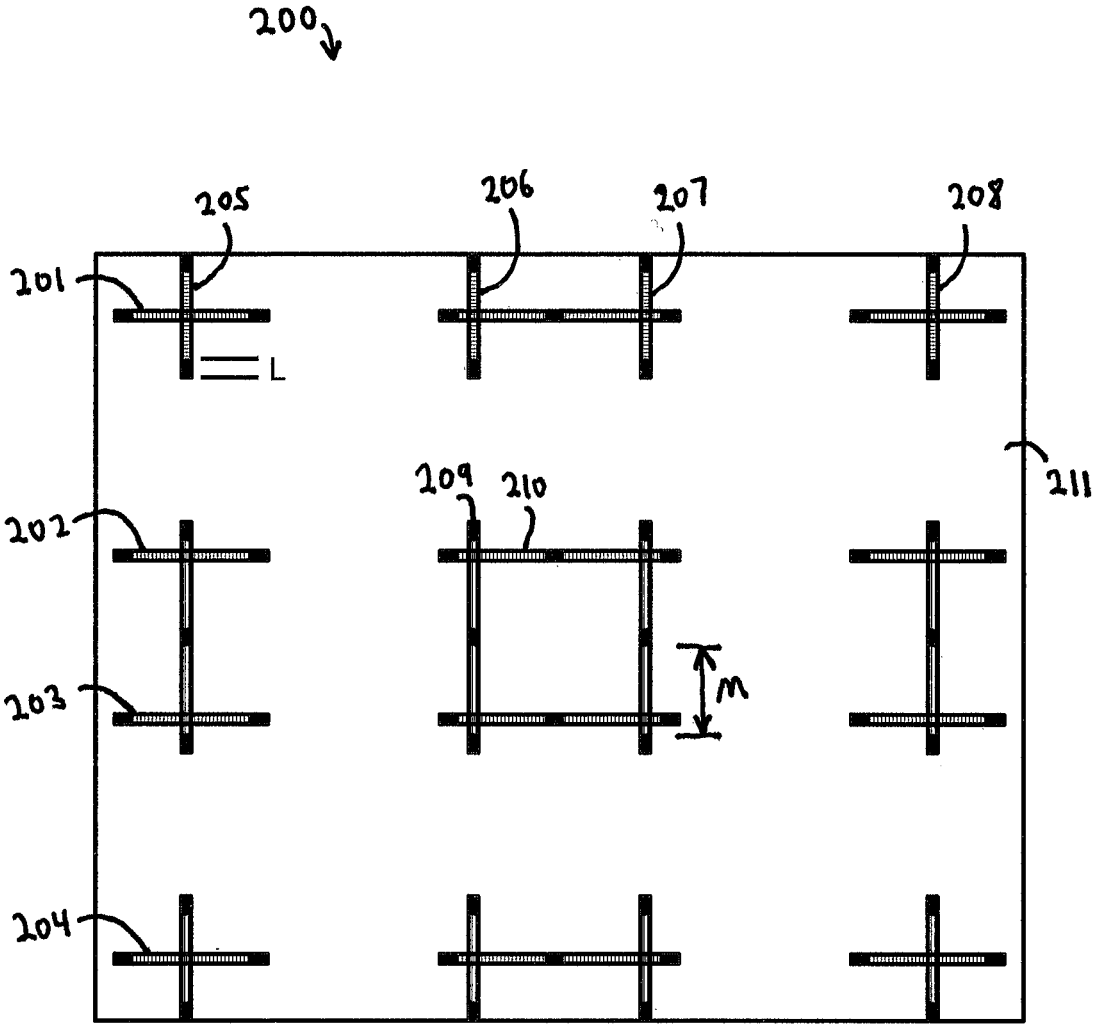
FIG. 12 is a bottom view drawing of a four rib folded interlocked deck corrugated skid in accordance with the invention with rib top cuts and scores marked.

FIG. 12 is a bottom view drawing of a four rib folded interlocked deck corrugated skid in accordance with the invention with rib top cuts and scores marked. In addition to the location and dimensions of the folded support ribs, I have also found that the rib top scoring configuration can significantly impact the skid performance. It is desirable that the ribs fold easily and have reduced folding memory. In addition, it is also desirable that the rib tops sit firmly on the floor in use to prevent sliding out and loss of load support. The skid 200 has four folded intersecting ribs in each direction 201, 202, 203, 204, 205, 206, 207, 208. The rib tops preferably have hinge sections 209 and cut open sections 210. The hinge sections 209 are preferably comprised of double spaced apart scores that are set apart wider than the thickness of the corrugated board. This reduces stress in the corrugated board and prevents liner splitting even with highly recycled corrugated board. The hinge sections 209 are preferably located on each end of each rib section 201-208 such that handing and sliding of the skid 200 can not cause a rib to open. The cut open sections 210 extend further and provide a broader flat surface that sits stably on the floor as opposed to hinge sections 209 that are raised slightly above the floor. In preferred embodiments, the hinge length in inches, L, is set such that 0.75"≤L≤2.5". Likewise cut open length in inches, M, is set such that 4.0"≤M≤8.0". In addition, cut open sections preferably exist on both sides of each intersection of ribs to prevent potential rolling over of ribs during handling and use.

Figure 13A:
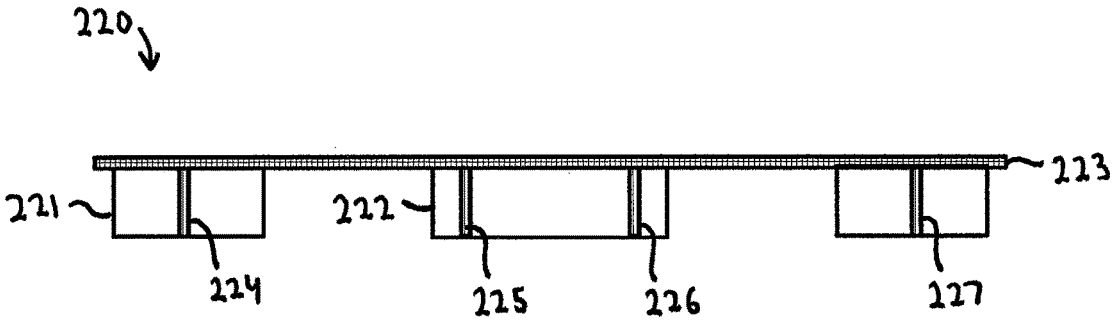
FIGS. 13 A and B are side and bottom view drawings of a two way, four rib folded interlocked deck corrugated skid showing the unsupported deck area in accordance with the invention.
Figure 13B:
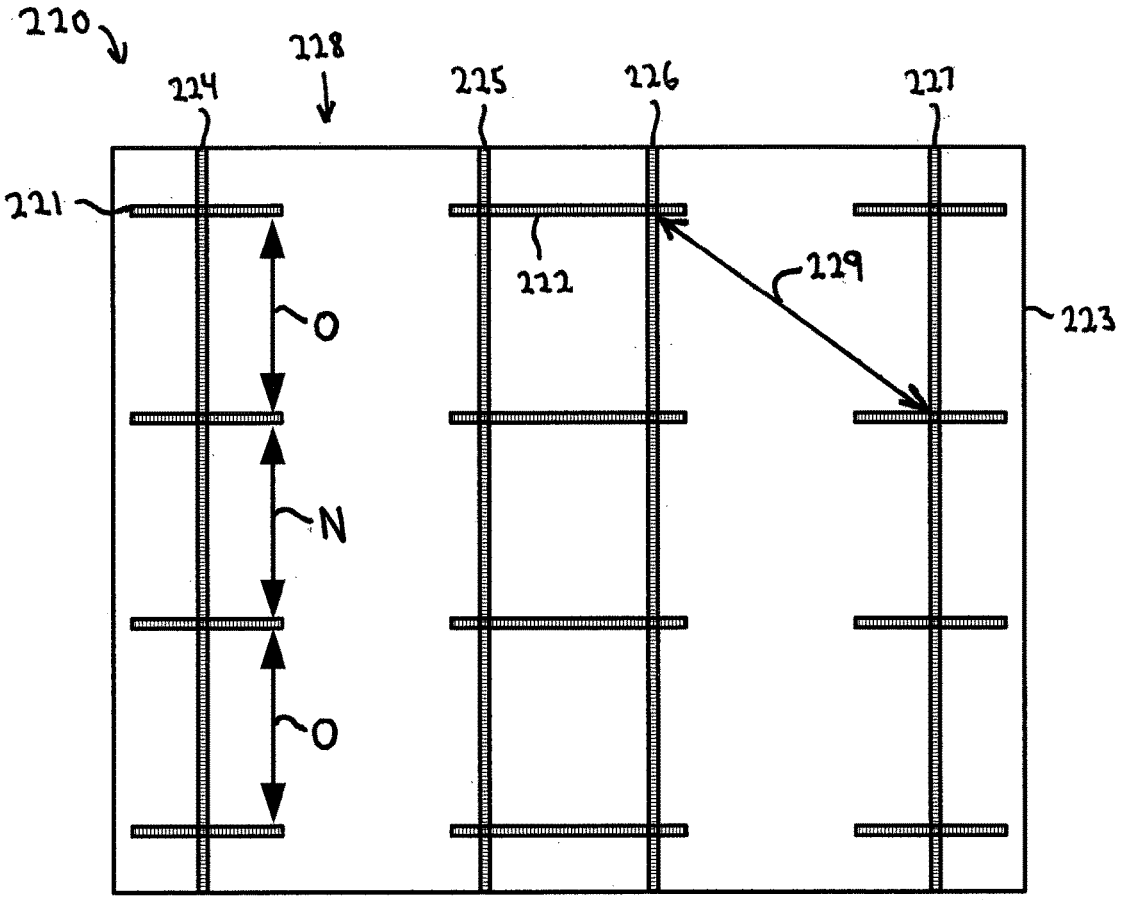

FIGS. 13 A and B are side and bottom view drawings of a two way, four rib folded interlocked deck corrugated skid showing the unsupported deck area in accordance with the invention. The corrugated skid 220 is comprised of a double thickness deck 223 and top blank rib sections 221, 222 that are folded down from the deck 223. Four bottom blank ribs 224, 225, 226, 227 intersect perpendicularly with top blank rib sections 221, 222. The center two bottom blank ribs 225, 226 lock together with center top blank rib section 222, forming a continuous four-sided rib support rectangle that resists shifting between the top blank and the bottom blank. The two way construction has fork entries 228 only on two sides of the corrugated skid 220 and is stronger and more durable than four way versions. The bottom blank ribs 224, 225, 226, 227 preferably run continuously between opposite ends of the corrugated skid 220 and are intersected by four top blank ribs 221 each separated by spaces, with middle space, N and outer spaces O. Support for the double thickness deck 223 is preferably maximized along with resistance against rib deflection for maintaining rib orientation vertical by having middle space, N, and two outer spaces, O, wherein 0.7≤(N/O)≤1.3. With this construction, the distances 229 between perpendicular supports 226, 227 and 221 and 222 is minimized. In addition to providing more uniform top deck support for smaller sized boxes and loads, the spacing of the top blank ribs distributes the resistance to rolling or deviation of the bottom blank ribs due to handling.

Figure 14:
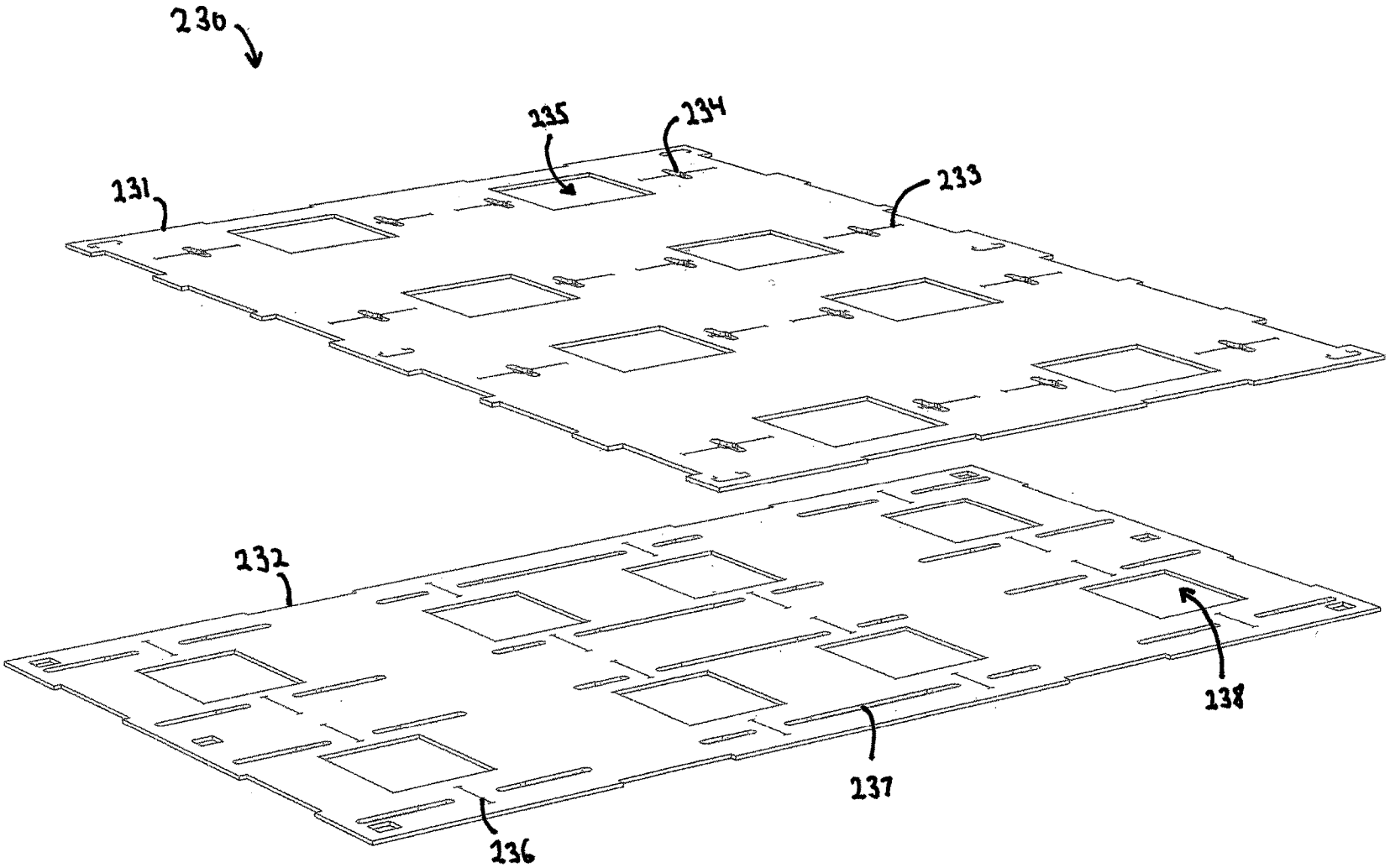
FIG. 14 is an isometric drawing of a four rib folded interlocked deck corrugated skid in accordance with the invention shown in flat blank state.

FIG. 14 is an isometric drawing of a four rib folded interlocked deck corrugated skid in accordance with the invention shown in flat blank state. The skid 230 is comprised of a top blank 231 and a bottom blank 232. The top blank 231 has four rib top fold lines 233 and sixteen notches for mating with the bottom blank 232 when folded and assembled together. Eight cutouts 235 provide for fork passages in two directions. The bottom blank 232 has four rib top fold lines 236 and twenty eight slots 237 for receiving ribs of the top blank 231 when folded and assembled together. Eight cutouts 238 provide for fork passages in two directions.

Figure 15:
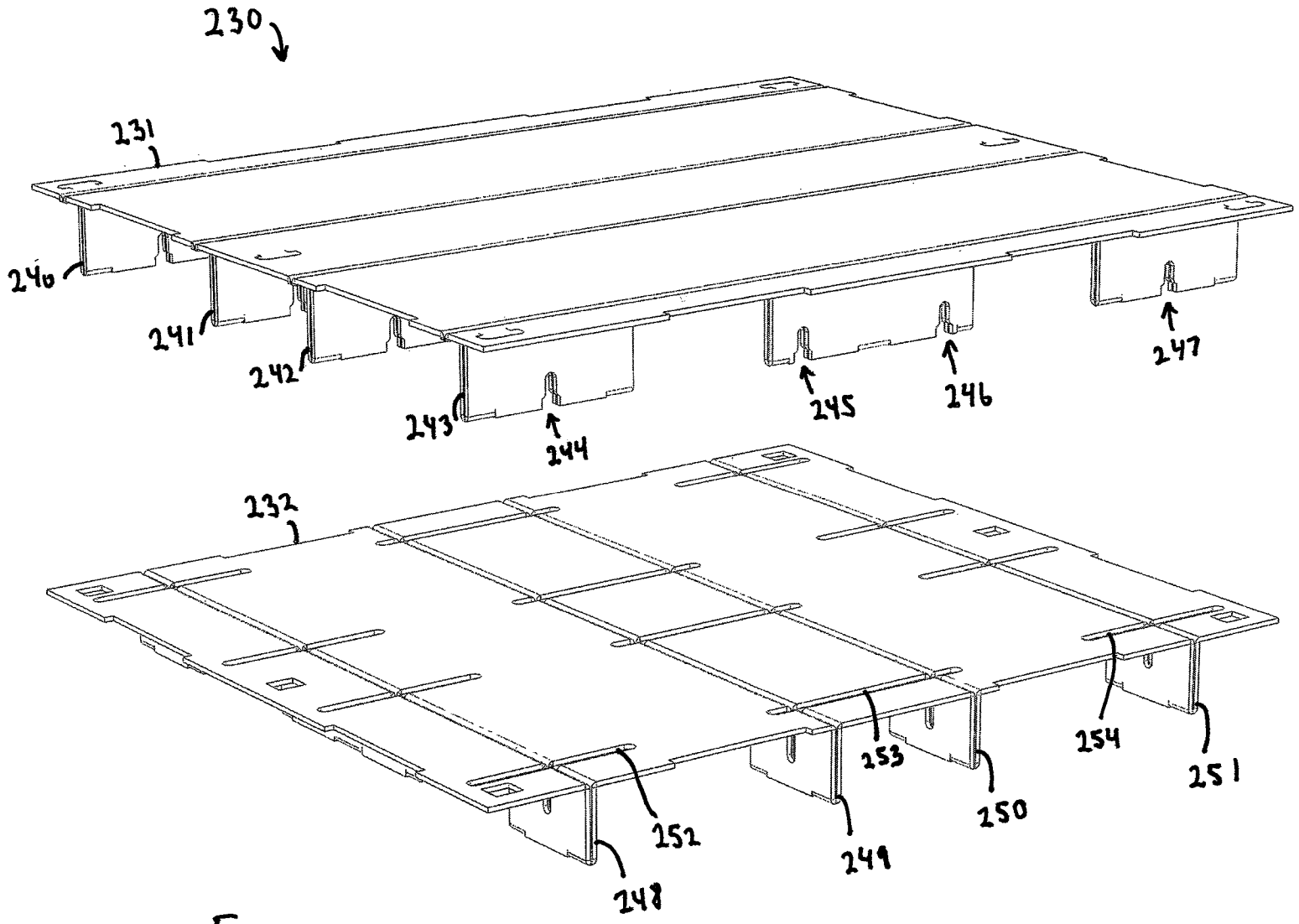
FIG. 15 is an isometric drawing of a four rib folded interlocked deck corrugated skid in accordance with the invention shown with ribs folded.

FIG. 15 is an isometric drawing of a four rib folded interlocked deck corrugated skid in accordance with the invention shown in with ribs folded. The skid 230 is comprise a top blank 231 and a bottom blank 232, each folded to produce four sets of vertically extending support ribs 240, 241, 242, 243, 248, 249, 250, 251. Top blank ribs 240, 241, 242, 243 each have four downward opening notches 244, 245, 246, 247. When bottom blank ribs 248, 249, 250, 251 are folded, the bottom blank has twelve sets of slots 252, 253, 254 for receiving top blank ribs 240, 241, 242, 243.

Figure 16:
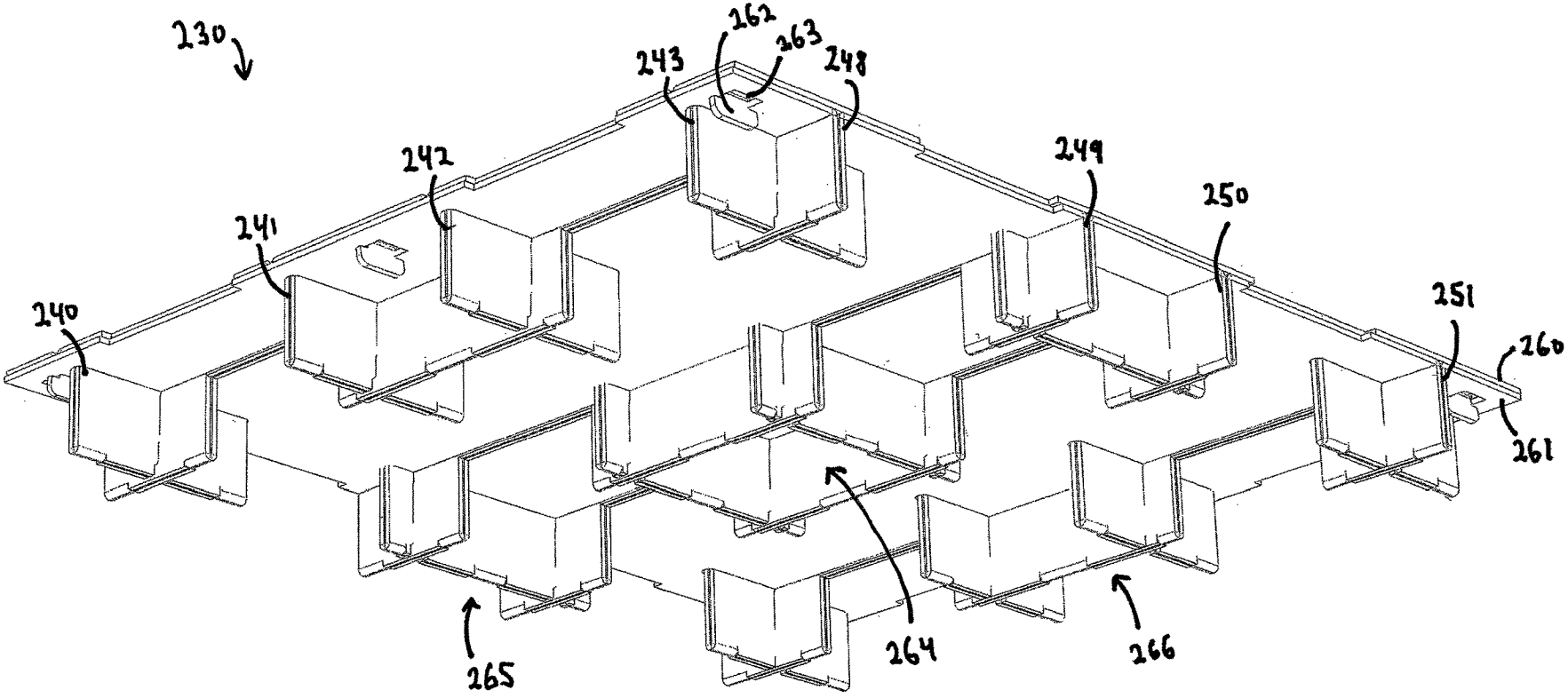
FIG. 16 is an isometric bottom view of a four rib folded interlocked deck corrugated skid in accordance with the invention shown assembled.

FIG. 16 is an isometric drawing of a four rib folded interlocked deck corrugated skid in accordance with the invention shown assembled. The skid 230 when completely assembled has four rows of top blank ribs 240, 241, 242, 243 that fold from the top blank deck 260 portion and penetrate slots in the bottom blank deck portion 261, intersecting perpendicularly with four rows of bottom blank ribs 248, 249, 250, 251. The blanks maybe further locked together by top blank corner locking tabs 262 being inserted through bottom blank corner locking recesses 263. In assembled form, the skid provides a surprisingly increased lateral support against ribs from sliding out sideways because of the fourth rib and connections thereof in the center. A locked together four sided parallelogram of intersecting ribs 264 is located centrally in the skid. The parallelogram resists lateral shifting of the top and bottom blanks 231, 232 even when the skid 230 may be slid in use. In addition, the three rib H formations 265 and 266 further constrain the skid ribs to remain vertical in the two respective directions. The end result is a new skid with minimal increased use of board but with both greatly improved double thickness deck support and resistance to support rib angular displacement and loss of support.

Obviously, numerous modifications and variations of the described preferred embodiment are possible and will occur to those skilled in the art in light of this disclosure of the invention. Accordingly, I intend that these modifications and variations, and the equivalents thereof, be included within the spirit and scope of the invention as defined in the following claims, wherein I claim:

The invention claimed is:

1. A corrugated skid comprised of a top blank and a bottom blank that are folded and assembled together wherein each blank comprises root fold lines for folding at least two double thickness ribs downward from integral deck portions;

said ribs of said top blank are each split into rib sections, including a center rib section and multiple side rib sections, and said bottom blank has slots in a bottom blank deck portion for receiving said rib sections of said top blank penetrating through said slots, and said double thickness ribs of said top and bottom blanks intersect with notches at locations below said integral deck portions;

said double thickness ribs of said top and bottom blanks intersect each other centrally of said corrugated skid to form a continuous four-sided rib support rectangle with four corners, wherein said center rib section of said top blank ribs includes two center notches and is continuous between said center notches, whereby angular deviation of said ribs from vertical, between said integral deck portions and crest portions of said ribs resting directly on a floor, is restrained by restraints at four upper elevation locations and at four lower elevation locations;

said restraints comprise said corners of said continuous four-sided rib support rectangle at said upper elevation where said center rib sections penetrate said slots, and directly below at said lower elevation where said notches of said bottom blank intersect with said center notches of said continuous center rib sections of said top blank.

2. A corrugated skid as defined in claim 1 wherein:

folding of said ribs comprises folds along said root fold lines at said integral deck portions, and along crest fold lines intermediate said root fold lines at distal ends of said ribs, said crest fold lines of said ribs comprise cut open sections that rest directly on said floor separated by shorter length hinge sections raised above said floor.

3. A corrugated skid as defined in claim 1 wherein:

said ribs of said bottom blank run continuously between opposite ends of said skid and are intersected by four of said top blank ribs, each separated by spaces, including middle space N and two outer spaces O;

wherein $0.7 \leq (N/O) \leq 1.3$.

4. A corrugated skid as defined in claim 1 wherein:

said corrugated skid has a top blank width in inches, A, and a bottom blank outer rib spacing in inches, E, wherein $7.0 \leq (A-E) \leq 12.0$.

5. A corrugated skid as defined in claim 1 wherein:

said corrugated skid has a top blank outer fork passage width, B, and a top blank inner fork passage width, C, wherein $0.35 \leq (C/B) \leq 0.45$.

6. A corrugated skid as defined in claim 1 wherein:

said corrugated skid has a top blank width in inches, A, a top blank outer fork passage width in inches, B, and a top blank inner fork passage width in inches, C, wherein if $A \geq 39$, then $B \leq 30$ and $C \geq 10$, and if $A < 39$, then $B \leq 24.25$ and $C \geq 6$.

7. A corrugated skid comprised of a top blank and a bottom blank that are folded and assembled together wherein each blank comprises root fold lines for folding double thickness ribs downward from integral deck portions and terminating in floor contacting crest portions;

said ribs of said top blank are each split into rib sections, including a center rib section and multiple side rib sections, and said bottom blank has slots in a bottom blank deck portion for receiving said rib sections of said top blank penetrating through said slots, and said double thickness ribs of said top and bottom blanks intersect with notches at locations below said integral deck portions;

vertical orientation of said bottom blank ribs of said corrugated skid, between said integral deck portions and said crest portions of said ribs resting directly on said floor is maintained by said center rib section of said top blank ribs comprising two notches and penetrating through only a single slot in said bottom blank deck portion.

8. A corrugated skid as defined in claim 7 wherein:

folding of said ribs comprises folds along said root fold lines at said integral deck portions, and along crest fold lines intermediate said root fold lines at distal ends of said ribs, said crest fold lines of said ribs comprise cut open sections that rest directly on said floor separated by shorter length hinge sections raised above said floor.

9. A corrugated skid as defined in claim 7 wherein:

said ribs of said bottom blank run continuously between opposite ends of said skid and are intersected by four of said ribs of said top blank each separated by spaces, middle space, N, and two outer spaces, O;

wherein $0.7 \leq (N/O) \leq 1.3$.

10. A corrugated skid as defined in claim 7 wherein:

said corrugated skid has a top blank width in inches, A, and a bottom blank outer rib spacing in inches, E, wherein $7.0 \leq (A-E) \leq 12.0$.

11. A corrugated skid as defined in claim 7 wherein:

said corrugated skid has a top blank outer fork passage width, B, and a top blank inner fork passage width, C, wherein $0.35 \leq (C/B) \leq 0.45$.

12. A corrugated skid as defined in claim 7 wherein:

said corrugated skid has a top blank width in inches, A, a top blank outer fork passage width in inches, B, and a top blank inner fork passage width in inches, C, wherein if $A \geq 39$, then $B \leq 30$ and $C \geq 10$, and if $A < 39$, then $B \leq 24.25$ and $C \geq 6$.

13. A corrugated skid comprised of a top blank and a bottom blank that are folded and assembled together wherein each blank comprises root fold lines for folding double thickness ribs downward from integral deck portions;

said ribs of said top blank are each split into rib sections, including a center rib section and multiple side rib sections, and said bottom blank has slots in a bottom blank deck portion for receiving said rib sections of said top blank penetrating through said slots, and said double thickness ribs of said top and bottom blanks intersect with notches at locations below said integral deck portions;

said ribs comprise folds along crest fold lines intermediate said root fold lines at distal ends of said ribs, and said crest fold lines of said ribs comprise cut open sections that rest directly on a floor;

adjacent sides of said cut open sections are restrained from relative vertical translation and to rest squarely on said floor by said center rib section of said top blank having four intersections of said notches with said ribs of said bottom blank directly below said center rib section of said top blank ribs penetrating through said slots of said bottom blank deck portion.

14. A corrugated skid as defined in claim 13 wherein:

said ribs of said bottom blank run continuously between opposite ends of said skid and are intersected by four of said ribs of said top blank, each separated by spaces, middle space, N, and two outer spaces, O;

wherein $0.7 \leq (N/O) \leq 1.3$.

15. A corrugated skid as defined in claim 13 wherein:

said corrugated skid has a top blank width in inches, A, and a bottom blank outer rib spacing in inches, E, wherein $7.0 \leq (A-E) \leq 12.0$.

16. A corrugated skid as defined in claim 13 wherein:

said corrugated skid has a top blank outer fork passage width, B, and a top blank inner fork passage width, C, wherein $0.35 \leq (C/B) \leq 0.45$.

17. A corrugated skid as defined in claim 13 wherein:

said corrugated skid has a top blank width in inches, A, a top blank outer fork passage width in inches, B, and a top blank inner fork passage width in inches, C, wherein if $A \geq 39$, then $B \leq 30$ and $C \geq 10$, and if $A < 39$, then $B \leq 24.25$ and $C \geq 6$.

* * * * *